US009914320B1

(12) United States Patent
Carberry et al.

(10) Patent No.: US 9,914,320 B1
(45) Date of Patent: Mar. 13, 2018

(54) SECURE VALUE BEARING INDICIA USING CLEAR MEDIA

(75) Inventors: Jeffery M. Carberry, Redondo Beach, CA (US); David E. Rosen, Los Angeles, CA (US); John R. Clem, Redondo Beach, CA (US); Haining B. Zhang, West Covina, CA (US)

(73) Assignee: Stamps.com Inc., El Segundo, CA (US)

( * ) Notice: Subject to any disclaimer, the term of this patent is extended or adjusted under 35 U.S.C. 154(b) by 1292 days.

(21) Appl. No.: 13/091,745

(22) Filed: Apr. 21, 2011

(51) Int. Cl.
*B42D 25/346* (2014.01)

(52) U.S. Cl.
CPC ..... *B42D 25/346* (2014.10)

(58) Field of Classification Search
CPC ..... B42D 25/346
USPC .... 283/71, 101, 103, 105, 107, 108; 40/638; 428/43
See application file for complete search history.

(56) References Cited

U.S. PATENT DOCUMENTS

| | | | |
|---|---|---|---|
| 1,684,756 | A | 9/1928 | Close |
| 1,988,908 | A | 1/1935 | MacKinnon |
| 2,825,498 | A | 3/1958 | Alves |
| 2,887,326 | A | 5/1959 | Kramer |
| 2,964,232 | A | 12/1960 | Levyn |
| 3,221,980 | A | 12/1965 | Mercur |
| 3,380,648 | A | 4/1968 | Lyra |
| 3,658,239 | A | 4/1972 | Foutz |
| 3,747,837 | A | 7/1973 | Wilson |
| 3,938,095 | A | 2/1976 | Check, Jr. et al. |
| 3,978,457 | A | 8/1976 | Check, Jr. et al. |
| 4,245,775 | A | 1/1981 | Conn |

(Continued)

FOREIGN PATENT DOCUMENTS

| | | | |
|---|---|---|---|
| DE | 4409386 | A1 | 9/1995 |
| EP | 0137737 | A2 | 4/1985 |

(Continued)

OTHER PUBLICATIONS

U.S. Appl. No. 11/779,443, Kara.

(Continued)

*Primary Examiner* — Kyle Grabowski
(74) *Attorney, Agent, or Firm* — Norton Rose Fulbright US LLP

(57) ABSTRACT

Systems and methods which provide secure value bearing indicia using clear media are shown. Embodiments of the invention provide value bearing indicia on clear media having security features to discourage reuse and/or copying. Embodiments provide value bearing indicia on clear media having controlled cuts in the surface of the clear media to facilitate the destruction of the value bearing indicia when removal is attempted after affixing to a host object. Patterns in which controlled cuts are provided in the clear media are preferably adapted to facilitate desired destruction of the value bearing indicia on clear media. Embodiments may utilize adhesive patterning to facilitate destruction or otherwise disabling the clear fungible postage indicia when removal from a host object is attempted. Embodiments of the invention may additionally or alternatively use adhesive adaption, such as adhesive colorization and/or adhesive characteristic variation, to provide security with respect to clear fungible postage indicia.

48 Claims, 9 Drawing Sheets

(56) References Cited

U.S. PATENT DOCUMENTS 4,271,481 A 6/1981 Check, Jr. et al.
4,308,299 A 12/1981 Check, Jr. et al.
4,511,793 A 4/1985 Racanelli
4,565,317 A 1/1986 Kranz
4,629,871 A 12/1986 Scribner et al.
4,641,347 A 2/1987 Clark et al.
4,649,266 A 3/1987 Eckert
4,661,001 A 4/1987 Takai et al.
4,682,793 A 7/1987 Walz
4,709,850 A 12/1987 Wagner
4,725,718 A 2/1988 Sansone et al.
4,743,747 A 5/1988 Fougere et al.
4,757,537 A 7/1988 Edelmann et al.
4,760,532 A 7/1988 Sansone et al.
4,763,271 A 8/1988 Field
4,775,246 A 10/1988 Edelmann et al.
4,784,317 A 11/1988 Chen et al.
4,800,504 A 1/1989 Durst, Jr. et al.
4,800,506 A 1/1989 Axelrod et al.
4,802,218 A 1/1989 Wright et al.
4,812,994 A 3/1989 Taylor et al.
4,821,195 A 4/1989 Baer et al.
4,831,554 A 5/1989 Storace et al.
4,831,555 A 5/1989 Sansone et al.
4,853,865 A 8/1989 Sansone et al.
4,862,386 A 8/1989 Axelrod et al.
4,864,618 A 9/1989 Wright et al.
4,868,757 A 9/1989 Gil
4,872,705 A 10/1989 Hartfeil
4,872,706 A 10/1989 Brewen et al.
4,900,903 A 2/1990 Wright et al.
4,900,904 A 2/1990 Wright et al.
4,901,241 A 2/1990 Schneck
4,907,161 A 3/1990 Sansone et al.
4,910,686 A 3/1990 Chang et al.
4,919,325 A 4/1990 Culver
4,933,849 A 6/1990 Connell et al.
4,934,846 A 6/1990 Gilham et al.
4,947,333 A 8/1990 Sansone et al.
4,993,752 A 2/1991 Juszak
4,998,204 A 3/1991 Sansone et al.
5,025,141 A 6/1991 Bolan
5,065,000 A 11/1991 Pusic
5,085,470 A 2/1992 Peach et al.
5,091,771 A 2/1992 Bolan et al.
5,111,030 A 5/1992 Brasington et al.
5,119,306 A 6/1992 Metelits et al.
5,136,647 A 8/1992 Haber et al.
5,200,903 A 4/1993 Gilham et al.
5,237,506 A 8/1993 Horbal et al.
5,239,168 A 8/1993 Dursty, Jr. et al.
5,316,208 A 5/1994 Petkovsek
5,319,562 A 6/1994 Whitehouse
5,329,713 A 7/1994 Lundell
5,341,505 A 8/1994 Whitehouse
5,360,628 A 11/1994 Butland
5,388,049 A 2/1995 Sansone et al.
5,410,642 A 4/1995 Hakamatsuka et al.
5,423,573 A 6/1995 de Passille
5,425,586 A 6/1995 Berson
5,437,441 A 8/1995 Tuhro et al.
5,439,721 A 8/1995 Pedroli et al.
5,449,200 A 9/1995 Andric et al.
5,454,038 A 9/1995 Cordery et al.
5,471,925 A 12/1995 Heinrich et al.
5,476,420 A 12/1995 Manning
5,490,077 A 2/1996 Freytag
5,494,445 A 2/1996 Sekiguchi et al.
5,501,393 A 3/1996 Walz
5,510,992 A 4/1996 Kara
5,524,995 A 6/1996 Brookner et al.
5,554,842 A 9/1996 Connell et al.
5,573,277 A 11/1996 Petkovsek
5,598,970 A 2/1997 Mudry et al.
5,600,562 A 2/1997 Guenther
5,601,313 A 2/1997 Konkol et al.
5,602,743 A 2/1997 Fraytag
5,606,507 A 2/1997 Kara
5,612,889 A 3/1997 Pintsov et al.
5,615,123 A 3/1997 Davidson et al.
5,617,519 A 4/1997 Herbert
5,650,934 A 7/1997 Manduley
5,651,238 A 7/1997 Belec et al.
5,666,215 A 9/1997 Fredlund et al.
5,666,284 A 9/1997 Kara
5,682,318 A 10/1997 Kara
5,717,597 A 2/1998 Kara
5,717,980 A 2/1998 Oka et al.
5,737,729 A 4/1998 Denman
5,774,886 A 6/1998 Kara
5,778,076 A 7/1998 Kara et al.
5,791,553 A 8/1998 Fabel
5,796,834 A 8/1998 Whitney et al.
5,801,364 A 9/1998 Kara et al.
5,801,944 A 9/1998 Kara
5,812,991 A 9/1998 Kara
5,819,240 A 10/1998 Kara
5,822,739 A 10/1998 Kara
5,825,893 A 10/1998 Kara
5,884,277 A 3/1999 Khosla
5,902,439 A 5/1999 Pike et al.
5,923,406 A 7/1999 Brasington et al.
5,924,738 A 7/1999 Konkol et al.
5,929,415 A 7/1999 Berson
5,932,139 A 8/1999 Oshima et al.
5,936,865 A 8/1999 Pintsov et al.
5,995,985 A 11/1999 Cai
6,005,945 A 12/1999 Whitehouse
6,010,156 A 1/2000 Block
6,026,385 A 2/2000 Harvey et al.
6,033,751 A 3/2000 Kline
D434,438 S 11/2000 Kara
6,155,476 A 12/2000 Fabel
6,173,888 B1 1/2001 Fabel
6,175,826 B1 1/2001 Malandra, Jr. et al.
6,181,433 B1 1/2001 Hayama et al.
6,199,055 B1 3/2001 Kara et al.
6,208,980 B1 3/2001 Kara
6,209,779 B1 4/2001 Fabel
6,234,694 B1 5/2001 Brookner
6,249,777 B1 6/2001 Kara et al.
6,296,404 B1 10/2001 Pierce et al.
6,311,240 B1 10/2001 Boone et al.
6,322,192 B1 11/2001 Walker
6,385,504 B1 5/2002 Pintsov et al.
6,415,983 B1 7/2002 Ulvr et al.
6,427,021 B1 7/2002 Fischer et al.
6,438,530 B1 8/2002 Heiden et al.
6,461,063 B1 10/2002 Miller et al.
6,505,179 B1 1/2003 Kara
6,505,980 B1 1/2003 Allday
6,523,014 B1 2/2003 Pauschinger
6,526,391 B1 2/2003 Cordery et al.
6,594,374 B1 7/2003 Beckstrom et al.
6,595,412 B2 7/2003 Manduley
6,655,579 B1 12/2003 Delman et al.
6,671,813 B2 12/2003 Ananda
6,692,031 B2 2/2004 McGrew
6,697,822 B1 2/2004 Armatis et al.
6,701,304 B2 3/2004 Leon
6,722,563 B1 4/2004 Johnson et al.
6,735,575 B1 5/2004 Kara
6,820,201 B1 11/2004 Lincoln et al.
6,834,112 B1 12/2004 Brickell
6,834,273 B1 12/2004 Sansone et al.
6,868,406 B1 3/2005 Ogg et al.
6,904,168 B1 6/2005 Steinberg et al.
6,939,062 B2 9/2005 Ogg et al.
6,946,960 B2 9/2005 Sisson et al.
7,069,253 B2 6/2006 Leon
7,083,345 B1 8/2006 Kuwahara
7,085,725 B1 8/2006 Leon
7,117,363 B2 10/2006 Lincoln et al.
7,127,434 B2 10/2006 Burningham

(56) References Cited

U.S. PATENT DOCUMENTS

| | | | | |
|---|---|---|---|---|
| 7,149,726 | B1 | 12/2006 | Lingle et al. | |
| 7,162,460 | B2 | 1/2007 | Cleckler et al. | |
| 7,166,345 | B2 * | 1/2007 | Myers et al. | 428/43 |
| 7,191,158 | B2 | 3/2007 | Ogg et al. | |
| 7,194,957 | B1 | 3/2007 | Leon et al. | |
| 7,201,305 | B1 | 4/2007 | Correa | |
| 7,222,236 | B1 | 5/2007 | Pagel | |
| 7,234,645 | B2 | 6/2007 | Silverbrook et al. | |
| 7,243,842 | B1 | 7/2007 | Leon et al. | |
| 7,266,531 | B2 | 9/2007 | Pintsov et al. | |
| 7,305,556 | B2 | 12/2007 | Slick et al. | |
| 7,396,048 | B2 | 7/2008 | Janetzke et al. | |
| 7,418,599 | B2 | 8/2008 | Peters | |
| 7,509,291 | B2 | 3/2009 | McBride et al. | |
| 7,577,618 | B2 | 8/2009 | Raju et al. | |
| 7,828,223 | B1 | 11/2010 | Leon et al. | |
| 7,831,518 | B2 | 11/2010 | Montgomery et al. | |
| 2001/0042052 | A1 | 11/2001 | Leon | |
| 2001/0054153 | A1 | 12/2001 | Wheeler et al. | |
| 2002/0023057 | A1 | 2/2002 | Goodwin et al. | |
| 2002/0033598 | A1 | 3/2002 | Beasley | |
| 2002/0046195 | A1 | 4/2002 | Martin et al. | |
| 2002/0073039 | A1 | 6/2002 | Ogg et al. | |
| 2002/0083020 | A1 | 6/2002 | Leon | |
| 2002/0083021 | A1 | 6/2002 | Ryan et al. | |
| 2002/0149195 | A1 | 10/2002 | Beasley | |
| 2002/0190117 | A1 | 12/2002 | Manduley | |
| 2003/0002709 | A1 | 1/2003 | Wu | |
| 2003/0030270 | A1 | 2/2003 | Franko et al. | |
| 2003/0037008 | A1 | 2/2003 | Raju et al. | |
| 2003/0059635 | A1 | 3/2003 | Naasani | |
| 2003/0078893 | A1 | 4/2003 | Shah et al. | |
| 2003/0085565 | A1 * | 5/2003 | Asay | 283/103 |
| 2003/0088426 | A1 | 5/2003 | Benson et al. | |
| 2003/0101143 | A1 | 5/2003 | Montgomery et al. | |
| 2003/0101147 | A1 | 5/2003 | Montgomery et al. | |
| 2003/0101148 | A1 | 5/2003 | Montgomery et al. | |
| 2003/0140017 | A1 | 7/2003 | Patton et al. | |
| 2003/0144972 | A1 | 7/2003 | Cordery et al. | |
| 2004/0070194 | A1 | 4/2004 | Janetzke et al. | |
| 2004/0174012 | A1 | 9/2004 | Hagen | |
| 2004/0200902 | A1 | 10/2004 | Ishioroshi | |
| 2004/0215523 | A1 | 10/2004 | Wulff et al. | |
| 2004/0220935 | A1 | 11/2004 | McGraw et al. | |
| 2004/0236938 | A1 | 11/2004 | Callaghan | |
| 2004/0241424 | A1 | 12/2004 | Barbera-Guillem | |
| 2004/0254898 | A1 | 12/2004 | Parker et al. | |
| 2005/0065897 | A1 | 3/2005 | Ryan et al. | |
| 2005/0071296 | A1 | 3/2005 | Lepkofker | |
| 2005/0071297 | A1 | 3/2005 | Kara | |
| 2005/0080751 | A1 | 4/2005 | Burningham | |
| 2005/0082818 | A1 | 4/2005 | Mertens | |
| 2005/0114276 | A1 | 5/2005 | Hunter et al. | |
| 2005/0195214 | A1 | 9/2005 | Reid et al. | |
| 2006/0116971 | A1 | 6/2006 | Beckstrom et al. | |
| 2006/0136347 | A1 | 6/2006 | Reichelsheimer et al. | |
| 2006/0173796 | A1 | 8/2006 | Kara | |
| 2006/0287096 | A1 | 12/2006 | O'Kelley et al. | |
| 2007/0005518 | A1 | 1/2007 | Beckstrom et al. | |
| 2007/0011995 | A1 | 1/2007 | Weaver et al. | |
| 2007/0017985 | A1 | 1/2007 | Lapstun et al. | |
| 2007/0026184 | A1 * | 2/2007 | Ehreiser et al. | 428/43 |
| 2007/0100672 | A1 | 5/2007 | McBride et al. | |
| 2007/0198441 | A1 | 8/2007 | Kara | |
| 2007/0255664 | A1 | 11/2007 | Blumberg et al. | |
| 2009/0125561 | A1 | 5/2009 | Garcia | |

FOREIGN PATENT DOCUMENTS

| | | | |
|---|---|---|---|
| EP | 153816 | A2 | 9/1985 |
| EP | 0282359 | A2 | 9/1988 |
| EP | 0507562 | A2 | 10/1992 |
| EP | 0596706 | A1 | 5/1994 |
| EP | 0658861 | A1 | 6/1995 |
| EP | 0926630 | A2 | 6/1999 |
| FR | 2580844 | A1 | 10/1986 |
| GB | 2246929 | A | 2/1992 |
| GB | 2251210 | A | 7/1992 |
| GB | 2271452 | A | 4/1994 |
| JP | 63147673 | | 6/1988 |
| JP | 05-132049 | | 5/1993 |
| JP | 09-508220 | | 8/1997 |
| JP | 11-249205 | | 9/1999 |
| JP | 2005215905 | A | 8/2005 |
| WO | WO-88/01818 | A1 | 3/1988 |
| WO | WO-9427258 | A1 | 11/1994 |
| WO | WO-199519016 | A1 | 7/1995 |
| WO | WO-97/40472 | A1 | 10/1997 |
| WO | WO-98/14909 | | 4/1998 |

OTHER PUBLICATIONS

U.S. Appl. No. 11/729,148, Stamps.com.

Brown, B., "Internet Postage Services," PC Magazine, Jun. 6, 2000, p. 133, Ziff-Davis Publishing Company, 1 page.

Menezes, A.J. et al., "Handbook of Applied Cryptography," CRC Press LLC, 1997 (Excerpt—Cover pages and pp. 512-515), 22 pages.

Non-Final Office Action dated Feb. 23, 2011 for U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 8 pages.

Notice of Allowance dated Feb. 3, 2011 for U.S. Appl. No. 11/114,964 to Clem et al., filed Apr. 25, 2005, and entitled "Quality Assurance of Image-Customization of Computer-Based Value-Bearing Items," 7 pages.

Office Action issued for Japanese Patent Application No. 515,253/1997, dated Apr. 21,2009; 5 pages (with English language translation).

U.S. Appl. No. 10/994,698 to Leon et al., filed Nov. 22, 2004, and entitled "Image Customization of Computer-Based Value-Bearing Items," 126 pages.

U.S. Appl. No. 13/038,029 to Leon et al, filed Mar. 1, 2011 and entitled "Image-Customization of Computer-Based Value-Bearing Items," 131 pages.

U.S. Appl. No. 13/081,356 to Leon et al, filed Apr. 6, 2011 and entitled "Computer-Based Value-Bearing Item Customization Security," 136 pages.

"Endicia Announces PictureltPostage™ , " Jun. 6, 2005, http://www.endicia.com/-/media/Files/About%20Us/Press%20Room/Endicia_pr05-06-06.ashx>, 2 pages.

"Information-Based Indicia Program (IBIP) Performance Criteria for Information-Based Indicia and Security Architecture for Closed IBI Postage Metering Systems (PCIBI-C)," Jan. 12, 1999, The United States Postal Service (USPS), 49 pages.

"Zazzle® Offers Zazzle Custom Stamps™ for Business," May 17, 2006, https://www.zazzle.com/about/press/releases?pr=12624, 2 pages.

Final Office Action dated Dec. 10, 2008 for U.S. Appl. No. 10/994,914 to McBride et al., filed Nov. 22, 2004, and entitled "Customized Computer-Based Value-Bearing Item Quality Assurance," 25 pages.

Final Office Action dated Jan. 26, 2009 for U.S. Appl. No. 10/994,728 to Huebner et al., filed Nov. 22, 2004, and entitled "Printing of Computer-Based Value-Bearing Items," 13 pages.

Final Office Action dated Mar. 15, 2010 for U.S. Appl. No. 10/994,914 to McBride et al., filed Nov. 22, 2004, and entitled "Customized Computer-Based Value-Bearing Item Quality Assurance," 31 pages.

Inverview Summary dated Sep. 2, 2010 for U.S. Appl. No. 11/644,458 to Leon, filed Dec. 20, 2006, and entitled "Systems and Methods for Creating and Providing Shape-Customized, Computer-Based, Value-Bearing Items," 4 pages.

Non-Final Office Action dated Apr. 17, 2008 for U.S. Appl. No. 10/994,914 to McBride et al., filed Nov. 22, 2004, and entitled "Customized Computer-Based Value-Bearing Item Quality Assurance," 19 pages.

(56) References Cited

OTHER PUBLICATIONS

Non-Final Office Action dated Aug. 19, 2009 for U.S. Appl. No. 10/994,728 to Huebner et al., filed Nov. 22. 2004, and entitled "Printing of Computer-Based Value-Bearing Items," 13 pages.
Non-Final Office Action dated Aug. 26, 2009 for U.S. Appl. No. 10/994,914 to McBride et al., filed Nov. 22, 2004, and entitled "Customized Computer-Based Value-Bearing Item Quality Assurance," 29 pages.
Non-Final Office Action dated Jul. 12, 2007 for U.S. Appl. No. 10/991,241 to Kara, filed Nov. 17, 2004, and entitled "System and Method for Generating Personalized Postage Indicia," 11 pages.
Non-Final Office Action dated May 29, 2008 for U.S. Appl. No. 10/994,728 to Huebner et al., filed Nov. 22, 2004, and entitled "Printing of Computer-Based Value-Bearing Items," 11 pages.
Notice of Allowance dated Nov. 24, 2008 for U.S. Appl. No. 10/197,044 to Raju et al., filed Jul. 16, 2002, and entitled "Generic Value Bearing Item Labels," 7 pages.
Porter, William, "Canadians Take to Vanity Stamps in Very Big Way," Denver Post, Jul. 9, 2000, 2 pages.
Ralph, J. "What's Selling: From Bricks and Mortar to Bricks and Clicks," Playthings Magazine, Feb. 1, 2003, 4 pages.
U.S. Appl. No. 11/729,239 to Leon et al., filed Mar. 28, 2007 and entitled "Computer-Based Value-Bearing Item Customization Security," 131 pages.
U.S. Appl. No. 12/316,240 to Leon, filed Dec. 9, 2008, and entitled "Systems and Methods for Facilitating Replacement of Computer-Based Value-Bearing Items," 158 pages.
U.S. Appl. No. 12/500,970 to Clem, filed Jul. 10, 2009, and entitled "Automatic Guarantee Delivery Tracking and Reporting for United States Postal Service Postage Refunds for Paid Computer-Based Postage," 70 pages.
U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 65 pages.
Examiner's Answer to Appeal Brief dated Feb. 19, 2009 for U.S. Appl. No. 10/991,241 to Kara, filed Nov. 17, 2004, and entitled "System and Method for Generating Personalized Postage Indicia," 14 pages.
Final Office Action dated Dec. 4, 2009 for U.S. Appl. No. 11/644,458 to Leon, filed Dec. 20, 2006, and entitled "Systems and Methods for Creating and Providing Shape-Customized, Computer-Based, Value-Bearing Items," 17 pages.
Final Office Action dated Jan. 31, 2006 for U.S. Appl. No. 10/991,241 to Kara, filed Nov. 17, 2004, and entitled "System and Method for Generating Personalized Postage Indicia," 13 pages.
Final Office Action dated Jun. 30, 2010 for U.S. Appl. No. 11/114,964 to Clem et al., filed Apr. 25, 2005, and entitled "Quality Assurance of Image-Customization of Computer-Based Value-Bearing Items," 23 pages.
Final Office Action dated Apr. 21, 2010 for U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 12 pages.
Final Office Action dated Mar. 16, 2010 for U.S. Appl. No. 10/994,728 to Huebner et al., filed Nov. 22, 2004, and entitled "Printing of Computer-Based Value-Bearing Items," 13 pages.
Final Office Action dated Nov. 4, 2010 for U.S. Appl. No. 11/644,458 to Leon, filed Dec. 20, 2006, and entitled "Systems and Methods for Creating and Providing Shape-Customized, Computer-Based, Value-Bearing Items," 22 pages.
Non-Final Office Action dated Dec. 23, 2009 for U.S. Appl. No. 11/114,964 to Clem et al., filed Apr. 25, 2005, and entitled "Quality Assurance of Image-Customization of Computer-Based Value-Bearing Items," 21 pages.
Non-Final Office Action dated Dec. 31, 2007 for U.S. Appl. No. 10/991,241 to Kara, filed Nov. 17, 2004, and entitled "System and Method for Generating Personalized Postage Indicia," 11 pages.
Non-Final Office Action dated Dec. 9, 2009 for U.S. Appl. No. 11/729,239 to Leon et al., filed Mar. 28, 2007, and entitled "Computer-Based Value-Bearing Item Customization Security," 6 pages.
Non-Final Office Action dated Jul. 19, 2005 for U.S. Appl. No. 10/991,241 to Kara, filed Nov. 17, 2004, and entitled "System and Method for Generating Personalized Postage Indicia," 9 pages.
Non-Final Office Action dated Jul. 21, 2010 for U.S. Appl. No. 10/994,914 to McBride et al., filed Nov. 22, 2004, and entitled "Customized Computer-Based Value-Bearing Item Quality Assurance," 33 pages.
Non-Final Office Action dated Jul. 7, 2008 for U.S. Appl. No. 10/991,241 to Kara, filed Nov. 17, 2004, and entitled "System and Method for Generating Personalized Postage Indicia," 12 pages.
Non-Final Office Action dated May 7, 2010 for U.S. Appl. No. 11/644,458 to Leon, filed Dec. 20, 2006, and entitled "Systems and Methods for Creating and Providing Shape-Customized, Computer-Based, Value-Bearing Items," 18 pages.
Non-Final Office Action dated Oct. 31, 2006 for U.S. Appl. No. 10/991,241 to Kara, filed Nov. 17, 2004, and entitled "System and Method for Generating Personalized Postage Indicia," 11 pages.
Notice of Allowance dated Aug. 5, 2010 for U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 11 pages.
Notice of Allowance dated Jun. 24, 2010 for U.S. Appl. No. 11/729,239 to Leon et al., filed Mar. 28, 2007, and entitled "Computer-Based Value-Bearing Item Customization Security," 6 pages.
Appeal Decision dated Apr. 20, 2010 for U.S. Appl. No. 10/991,241 to Kara, filed Nov. 17, 2004, and entitled "System and Method for Generating Personalized Postage Indicia," 9 pages.
Final Office Action dated Jun. 23, 2009 for U.S. Appl. No. 11/114,964 to Clem et al., filed Apr. 25, 2005, and entitled "Quality Assurance of Image-Customization of Computer-Based Value-Bearing Items," 11 pages.
Non-Final Office Action dated Apr. 16, 2009 for U.S. Appl. No. 11/644,458 to Leon, filed Dec. 20, 2006, and entitled "Systems and Methods for Creating and Providing Shape-Customized, Computer-Based, Value-Bearing Items," 15 pages.
Non-Final Office Action dated Aug. 11, 2009 for U.S. Appl. No. 11/435,453 to Clem., filed May 16, 2006, and entitled "Rolls of Image-Customized Value-Bearing Items and Systems and Methods for Providing Rolls of Image-Customized Value-Bearing Items," 9 pages.
Non-Final Office Action dated Dec. 12, 2007 for U.S. Appl. No. 11/635,871 to McBride et al., filed Dec. 8, 2006, and entitled "Formatting Value-Bearing Item Indicia," 5 pages.
Non-Final Office Action dated Nov. 26, 2008 for U.S. Appl. No. 11/114,964 to Clem et al., filed Apr. 25, 2005, and entitled "Quality Assurance of Image-Customization of Computer-Based Value-Bearing Items," 9 pages.
Notice of Abandonment dated Jun. 30, 2010 for U.S. Appl. No. 10/991,241 to Kara, filed Nov. 17, 2004, and entitled "System and Method for Generating Personalized Postage Indicia" , 2 pages.
Notice of Allowance dated Jan. 5, 2007 for U.S. Appl. No. 10/994,768 to Leon et al., filed Nov. 22, 2004, and entitled "Computer-Based Value-Bearing item Customization Security," 7 pages.
Notice of Allowance dated Jul. 15, 2008 for U.S. Appl. No. 11/635,871 to McBride et al., filed Dec. 8, 2006, and entitled "Formatting Value-Bearing Item Indicia," 7 pages.
Notice of Allowance dated Nov. 17, 2008 for U.S. Appl. No. 11/635,871 to McBride et al., filed Dec. 8, 2006, and entitled "Formatting Value-Bearing Item Indicia," 7 pages.
U.S. Appl. No. 10/994,728 to Huebner et al., filed Nov. 22, 2004, and entitled "Printing of Computer-Based Value-Bearing Items," 122 pages.
U.S. Appl. No. 10/994,914 to McBride et al., filed Nov. 22, 2004, and entitled "Customized Computer-Based Value-Bearing Item Quality Assurance," 131 pages.
U.S. Appl. No. 11/114,964 to Clem et al., filed Apr. 25, 2005, and entitled "Quality Assurance of Image-Customization of Computer-Based Value-Bearing Items," 122 pages.

(56) References Cited

OTHER PUBLICATIONS

Computergram International, "U.S. Postal Service to Introduce PC Postage Plans Today," Aug. 9, 1999, No. 3720, 1 page.
Terrell, "Licking Stamps: A PC and a Printer Will End Trips to the Post Office," U.S. News & World Report, Sep. 28, 1998, vol. 125, No. 12, 4 pages.
"Miniature, Coin-Shaped Chip is Read or Written with a Touch," News Release, Dallas Semiconductor, Jul. 1991, 9 pages.
Stamps: Beyond Elvis, May 15, 1994, New York Times Archives, 2 pages.
Minnick, Robert, "Postage Imprinting Apparatus and Methods for Use With a Computer Printer", Apr. 27, 1995, 71 pages.
Final Office Action dated Mar. 4, 2009 for U.S. Appl. No. 10/994,698 to Leon et al., filed Nov. 22, 2004, and entitled "Image Customization of Computer-Based Value-Bearing Items," 12 pages.
Final Office Action dated May 11, 2010 for U.S. Appl. No. 10/994,698 to Leon et al., filed Nov. 22, 2004, and entitled "Image Customization of Computer-Based Value-Bearing Items," 18 pages.
Non-Final Office Action dated Aug. 19, 2008 for U.S. Appl. No. 10/994,698 to Leon et al., filed Nov. 22, 2004, and entitled "Image Customization of Computer-Based Value-Items," 16 pages.
Non-Final Office Action dated Aug. 3, 2009 for U.S. Appl. No. 10/994,698 to Leon et al., filed Nov. 22, 2004, and entitled "Image Customization of Computer-Based Value-Bearing Items," 13 pages.
Notice of Allowance dated Dec. 2, 2010 for U.S. Appl. No. 10/994,698 to Leon et al., filed Nov. 22, 2004, and entitled "Image Customization of Computer-Based Value-Bearing Items," 5 pages.
International Search Report attached to PCT Application WO/88/01818, dated Nov. 30, 1987, 2 pages.
International Search Report issued for Application PCT/US96/16366, dated Jun. 13, 1997, 9 pages.
U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 69 pages.
U.S. Appl. No. 11/644,458 to Leon, filed Dec. 20, 2006, and entitled "Systems and Methods for Creating and Providing Shape-Customized, Computer-Based, Value-Bearing Items," 77 pages.

* cited by examiner

SECURE VALUE BEARING INDICIA USING CLEAR MEDIA

CROSS-REFERENCE TO RELATED APPLICATIONS

The present application is related to co-pending and commonly assigned U.S. patent application Ser. No. 11/779,443 entitled "System and Method for Printing Multiple Postage Indicia," filed Jul. 18, 2007, and Ser. No. 11/729,148 entitled "Computer-Based Value-Bearing Item Customization Security," filed Mar. 27, 2007, the disclosures of which are hereby incorporated herein by reference.

TECHNICAL FIELD

The invention relates generally to value bearing indicia and, more particularly, to value bearing indicia using transparent or translucent media.

BACKGROUND OF THE INVENTION

Various forms of value bearing indicia have been used for a number of years. For example, postal services around the world have used value bearing indicia in the form of stamps for evidencing payment for postal services. Such stamps are provided in predetermined value denominations and typically comprise some form of preprinted paper or other relatively fragile medium. The stamps are generally applied to a postal item for which they are to provide evidence of postal service payment using a suitable adhesive to prevent removal and reuse of the stamp without their destruction (e.g., tearing of the stamp medium). Moreover, the stamps are "cancelled" (i.e., marked as used) by the postal service when processing the postal item to prevent reuse of the stamp.

Although the foregoing stamps provide useful value bearing indicia, they have not always provided the convenience desired by their users. For example, they must be prepurchased to be available for use by a postal customer when needed. Moreover, they are available only in the value denominations in which they are provided, whereas a user may desire some other denomination (e.g., a denomination which is not an integer multiple of the value bearing indicia value denomination). Accordingly, value bearing indicia in the form of postage meter indicia has been used by postal services.

Postage meter indicia provide value bearing indicia which are generated in desired value denominations by a user at or very near the time of posting a postal item. Such postage meter indicia includes both the more traditional value bearing indicia provided by a postage meter strike and the more modern information based indicia provided by processor-based postage metering systems (e.g., personal computer and/or Internet postage metering system configurations). The postage meter indicia may be imprinted directly upon the postal item or upon transfer media (e.g., paper label stock). In either case, the postage meter indicia is typically affixed to the postal item in such a way as to prevent removal and reuse of the postage meter indicia without their destruction. Moreover, the postage meter indicia are generated to include information therein (e.g., date, information uniquely linking the postage meter indicia to the postal item, information linking the postage meter indicia to the sender and/or intended recipient of the postal item, etc.) which prevent their reuse (e.g., at a date other than included in the indicium, on a postal item other than the one linked to the indicium, on a postal item to or from entities other than the sender and/or intended recipient linked to the indicium, etc.).

Although the foregoing postage meter indicia provide value bearing indicia having value determinations closely matched to the postal item with which they are to be used, they do not provide the ready availability that the aforementioned stamps do. That is, a user typically must utilize some form of meter system to generate the potage meter indicia, which may prove inconvenient and time consuming when the user desires to prepare a single postal item for posting. Accordingly, value bearing indicia in the form of fungible postage indicia has been more recently made available by postal services. Examples of fungible postage indicia are shown in U.S. Pat. No. 6,939,062 entitled "System and Layout for Proper Printing of NETSTAMPS and Other Labels" and U.S. Pat. No. 7,083,345 entitled "Roll Label Layout and System for Proper Printing of NETSTAMPS," assigned to the present assignee, the disclosures of which are incorporated herein by reference in their entirety.

Fungible postage indicia provide value bearing indicia which is somewhat of a hybrid between the aforementioned stamps and postage meter indicia. That is, a plurality of fungible postage indicia may be pre-produced in desired value denominations for later use in posting postal items. Thus, although some form of meter system is used to generate the fungible postage indicia, a plurality of such fungible postage indicia may be generated at a convenient time for their later use. The user may therefore be afforded the advantages provided by the use of postage meters (e.g., generating indicia in desired value denominations, obtaining postage value without traveling to a post office, postage accounting and reporting functionality, etc.) while enjoying convenience similar to that of "ready made" stamps.

The fungible postage indicia are printed upon transfer media (e.g., paper label stock) for affixing to the postal item in such a way as to prevent removal and reuse of the fungible postage indicia without their destruction. Although the fungible postage indicia may include a machine readable (e.g., two dimensional barcode) or other validation information portion similar to that of an information based indicium, the fungible postage indicia are fungible because they are dateless and are used without specified recipient addresses. Moreover, because the machine readable or other validation information portion is to remain readable for use in validating the fungible postage indicia, cancellation (i.e., applying a mark to the face of the fungible postage indicia to indicate it having been used) of the fungible postage indicia is generally not performed by the postal service. Thus, the use of paper label stock is relied upon to prevent removal and reuse of the fungible postage indicia without their destruction (e.g., tearing of the fungible postage indicia medium). Such paper label stock, however, often does not provide a postage indicia which is aesthetically pleasing when applied to a postal item (e.g., the color of the label stock does not match the stock of the postal item).

Various techniques may be implemented to prevent the copying and reproduction of fungible postage indicia (e.g., using xerographic equipment or computer-based scanner equipment). For example, special inks which are invisible under natural light, but which fluoresce under light of a particular wavelength (e.g., ultraviolet light), may be applied to the fungible postage indicia medium (e.g., as a marker) to render reproduction by typical copying techniques ineffective. Similarly, special inks which visually appear to have different characteristics (e.g., change color), such as thermochromatic inks, may be applied to the fungible postage indicium medium to render reproduction by typical copying techniques ineffective. However, these security measures, although effectively thwarting duplication, do nothing to prevent reuse of an otherwise properly generated fungible postage indicia. Accordingly, for the use of such fungible postage indicia in the United States Postal Service (USPS), the USPS has required that the fungible postage indicia be physically destroyed if removed from the postal item more than 24 hours after application thereto in order to prevent removal and reuse of the fungible postage indicia.

BRIEF SUMMARY OF THE INVENTION

The present invention is directed to systems and methods which provide secure value bearing indicia using transparent or translucent (collectively referred to herein as clear) media. Embodiments of the invention provide value bearing indicia in the form of fungible postage indicia borne on clear media (referred to herein as clear fungible postage indicia) and having one or more security features to prevent or otherwise discourage reuse and/or copying. Accordingly, value bearing indicia of the present invention may be provided in a form which may be unobtrusively applied to a host object (e.g., a postal item) without substantially impacting the aesthetic appeal of the host object and without substantial risk of improper reuse or copying of the value bearing indicia.

Clear media utilized in fungible postage indicia of embodiments of the invention may comprise various plastics (e.g., polyethylene, polypropylene, polystyrene, vinyl, polyester, etc.) formed into a thin sheet giving a desired level of transparency/translucency and flexibility of the material. Such plastic media, however, typically presents a relatively resilient membrane which is resistant to tearing, and other destructive forces. Accordingly, the use of clear media for fungible postage indicia presents an increased risk that the clear fungible postage may be reused.

Embodiments of the invention provide clear fungible postage indicia having one or more controlled cuts in the surface of the clear media to facilitate the destruction of the clear fungible postage indicia when removal is attempted after affixing to a host object. Controlled cuts utilized according to embodiments of the invention may comprise perforation lines (e.g., one or more discrete cuts fully penetrating the clear medium interleaved with one or more uncut portions of clear medium), score lines (e.g., a cut line partially penetrating the clear medium leaving some portion of clear medium uncut), etc.

Controlled cut configurations of embodiments of the invention present sufficient structural integrity for printing of the indicia and their initial application to a host object while introducing areas of diminished structural integrity adapted to facilitate destruction or otherwise disabling the clear fungible postage indicia when removal from a host object is attempted. For example, the ratio of the perforations (i.e., the ratio of perforation cut length to remaining web length) is adapted according to embodiments of the invention for the attributes of the clear medium and/or adhesive used in order to provide suitable security. Similarly, the score depth is adapted according to embodiments of the invention for the attributes of the clear medium and/or adhesive used in order to provide suitable security.

Patterns in which controlled cuts are provided in the clear media are preferably adapted to facilitate desired destruction of the clear fungible postage indicia. For example, a controlled cut pattern may be utilized which results in separation of particular portions of the clear fungible postage indicia (e.g., separation of a human readable portion, a machine readable portion, and an marker portion). Additionally or alternatively, a controlled cut pattern may be utilized which results in the breaking up of particular portions of the clear fungible postage indicia (e.g., breaking any of a human readable portion, a machine readable portion, and/or an marker portion into smaller pieces). Controlled cut patterns utilized according to embodiments of the invention may avoid controlled cuts in certain areas, such as a machine readable portion, in order to avoid interfering with the functionality of that portion of the clear fungible postage indicia. Alternatively, controlled cuts of a controlled cut pattern may be disposed in certain orientations and/or areas of the clear fungible postage indicia so as to facilitate the breaking up of a particular portion without substantially interfering with the functionality of that portion prior to destruction of the indicium.

Clear fungible postage indicia of embodiments may implement techniques in addition to or in the alternative to the foregoing controlled cuts for providing security. For example, embodiments of the invention may utilize adhesive patterning to facilitate destruction or otherwise disabling the clear fungible postage indicia when removal from a host object is attempted. According to an embodiment, adhesive patterning may deposit adhesive in particular areas and leave other areas free of adhesive (e.g., areas near and/or underlying a controlled cut) to work cooperatively with a controlled cut to facilitate separation of portions of the clear medium when the fungible postage indicia is removed from a host object.

Embodiments of the invention may additionally or alternatively use adhesive adaption to provide security with respect to clear fungible postage indicia. According to an embodiment, adhesive adaption in the form of adhesive colorization may be utilized to provide a pattern (e.g., image, logo, text, information, etc.) within the adhesive. Such a pattern is preferably visible through the clear fungible postage indicia and is provided in such a way as to be visibly altered or damaged (e.g., separated from the clear medium, partially separated from the clear medium, smudged or smeared, etc.) if the clear fungible postage indicia is removed from a host object. Additional or alternative embodiments utilize adhesive adaption in the form of adhesion characteristic variation to facilitate destruction or otherwise disabling the clear fungible postage indicia when removal from a host object is attempted. Such adhesion characteristic variation may comprise the use of adhesives of different adhesion characteristics used at different portions of the clear medium (e.g., exterior edges, portions at or near controlled cuts, beneath particular aspects of the fungible postage indicia, etc.) for facilitating destruction of the clear fungible postage indicia.

Security features, such as the use of special inks, may be utilized to prevent the copying and reproduction of clear fungible postage indicia according to embodiments of the invention. For example, special inks which are invisible under natural light, but which fluoresce under light of a particular wavelength (e.g., ultraviolet light), may be applied to the clear fungible postage indicia medium to render reproduction by typical copying techniques ineffective. The use of special inks which are invisible under natural light are particularly useful with respect to clear fungible postage indicia of embodiments due to their use not substantially impacting the aesthetics provided by the use of the clear fungible postage indicia. Special inks which visually appear to have different characteristics (e.g., change color), such as thermo-chromatic inks, may additionally or alternatively be applied to the clear fungible postage indicium medium to render reproduction by typical copying techniques ineffective. However, such visible inks may not be preferred according some embodiments due to its impact upon the aesthetics provided by the use of the clear fungible postage indicia.

The clear fungible postage indicia of embodiments of the invention provide postage indicia which are conveniently available for use, are available in denominations closely matching that needed for a particular postal item, are unobtrusive when applied to a host object, and provides security attributes facilitating their destruction upon removal from a host object. Accordingly, clear fungible postage indicia of embodiments herein provides a combination of features in postage indicia heretofore unavailable.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each, of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
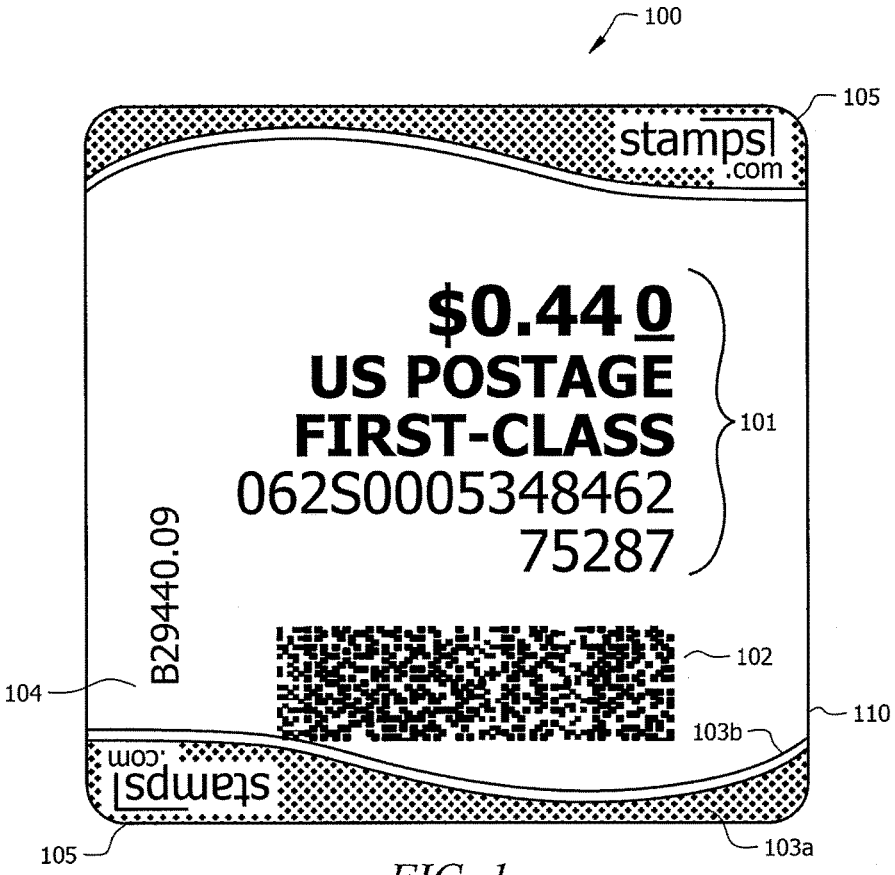
FIG. 1 shows a secure value bearing indicia using clear media according to embodiments of the invention.

FIG. 1 shows a secure value bearing indicia using transparent or translucent (collectively referred to herein as clear) media according to embodiments of the present invention. Embodiments of the secure value bearing indicia on clear media provide value bearing indicia in the form of fungible indicia in that any of a plurality of such indicia may be used interchangeably and thus are not limited to use in a particular transaction, with respect to a particular object, etc. For example, secure value bearing indicia on clear media provided according to embodiments of the invention may comprise fungible postage indicia suitable for use at any time with any postal item. Such clear fungible postage indicia provide fungible value bearing indicia similar to that of postage stamps. In contrast, typical information based postage indicia provided through use of a personal computer postage metering system would not be fungible due to the indicia each being uniquely tied to a particular postal item and it bearing a date corresponding to its date of posting. Similarly, typical postage meter indicia provided through the use of a postage meter system would not be fungible due to the indicia bearing a date corresponding to its date of posting.

It should be appreciated that, although embodiments are described herein with reference to the value bearing indicia comprising postage indicia, value bearing indicia provided according to the concepts herein may be utilized with respect to transactions other than postal services. For example, secure value bearing indicia on clear media provided according to embodiments of the invention may be utilized with respect to tickets, coupons, remittances, etc.

Referring still to FIG. 1, clear fungible postage indicium 100 of the illustrated embodiment is shown comprising clear medium 110 having various markings thereon. The markings shown with respect to clear fungible postage indicium 100 of the illustrated embodiment, for example, include human readable information 101, machine readable information 102, markers 103*a* and 103*b*, medium code 104, and aesthetics 105. Such markings, or portions thereof, may be provided for validation of the funds borne by the indicia, security, identification, information, instruction, etc.

Human readable indicia information 101 may comprise various information useful to a user of the indicium, a service provider processing the indicium, and/or other persons likely to be exposed to the indicium. For example, human readable indicia information 101 of the illustrated embodiment includes value amount, postage designation, postage class, meter number, and meter zip code.

Machine readable information 102 may comprise various information, provided in a machine readable format, useful to automated systems handling the indicium, such as mail processing systems, indicia validation systems, electronic commerce systems, and/or other systems likely to be exposed to the indicium. For example, machine readable information 102 of the illustrated embodiment comprises a two dimensional bar code providing robust (e.g., error correcting) encoding of information (e.g., on the order of 20-40 bytes) in a format which is readable by optical scanners. The machine readable information may comprise, for example, value amount, postage class, meter number, authentication information (e.g., digital signature), and/or other information useful in processing the indicium. According to embodiments of the invention, machine readable information 102 comprises a reduced content information based indicia (referred to as IBI light) as shown and described in U.S. patent application Ser. No. 11/729,148 entitled "Computer-Based Value-Bearing Item Customization Security", the disclosure of which is incorporated herein by reference.

Markers 103*a* and 103*b* may comprise various forms of marks to prevent the copying and reproduction of fungible postage indicia (e.g., using xerographic equipment or computer-based scanner equipment). For example, marker 103*a* may comprise one or more mark imprinted using a special ink which is invisible under natural light, but which fluoresce under light of a particular wavelength (e.g., ultraviolet light), thereby rendering reproduction of clear fungible postage indicium 100 by typical copying techniques ineffective. Additionally or alternatively, marker 103*b* may comprise one or more mark imprinted using a special ink which visually appears to have different characteristics (e.g., change color), such as thermo-chromatic inks, thereby rendering reproduction by typical copying techniques ineffective. Because clear fungible postage indicium 100 of embodiments is adapted to provide a value bearing indicia in a form which may be unobtrusively applied to a host object (e.g., a postal item) without substantially impacting the aesthetic appeal of the host object and without substantial risk of improper reuse or copying of the value bearing indicia, embodiments of the invention may utilize, the aforementioned invisible inks rather than inks which visually appear to have different characteristics. It should be appreciated that markers 103*a* and/or 103*b* may comprise a simple mark (e.g., the presence of which is simply detected or not), a more complex mark (e.g., a facing identification mark or other mark providing relatively simple information such as postal item face orientation), or an informational mark (e.g., barcode or other rich information carrying mark) according to embodiments of the invention.

Medium code 104 may comprise various information useful in creating and/or validating clear fungible postage indicium 100. For example, medium code 104 may comprise a medium serial number used in controlling the generation of clear fungible postage indicium 100. Such a medium serial number and/or other contents of medium code 104 may be encoded into machine readable indicia information 102, such as for use in validating clear fungible postage indicium 100. The use of serial numbers, as may comprise medium code 104, for controlling the generation of fungible postage indicia is shown and described in U.S. Pat. No. 7,191,158 entitled "System and Method for Providing Computer-Based Postage Stamps", the disclosure of which is incorporated herein by reference. It should be appreciated that medium code 104 of embodiments may be adapted to provide security features in addition to or in the alternative to the aforementioned use in creating and/or validating clear fungible postage indicium 100. For example, medium code 104 may be adapted to provide indication of tampering with or reuse of an otherwise valid clear fungible postage medium, such as using adhesive patterning techniques described below.

Aesthetics 105 may comprise various marks, information, etc. provided for aesthetic purposes. For example, aesthetics 105 may comprise logos of a service provider facilitating generation of clear fungible postage indicium 100, a postal service provider, an entity for which clear fungible postage indicium 100 was generated, etc. It should be appreciated that aesthetics 105 may be utilized for purposes in addition to or in the alternative to mere aesthetic ornamentation. For example, aesthetics 105 may include greetings, advertisements, or other messages. Likewise, aesthetics 105 may be adapted to provide security attributes, such as through imprinting aesthetics 105 using special inks as described above, using adhesive patterning techniques described below, etc. For example, aesthetics 105 may be printed using special inks, such as the florescent or thermo-chromatic inks discussed above, for providing security with respect to clear fungible postage indicium 100.

Figure 2A:
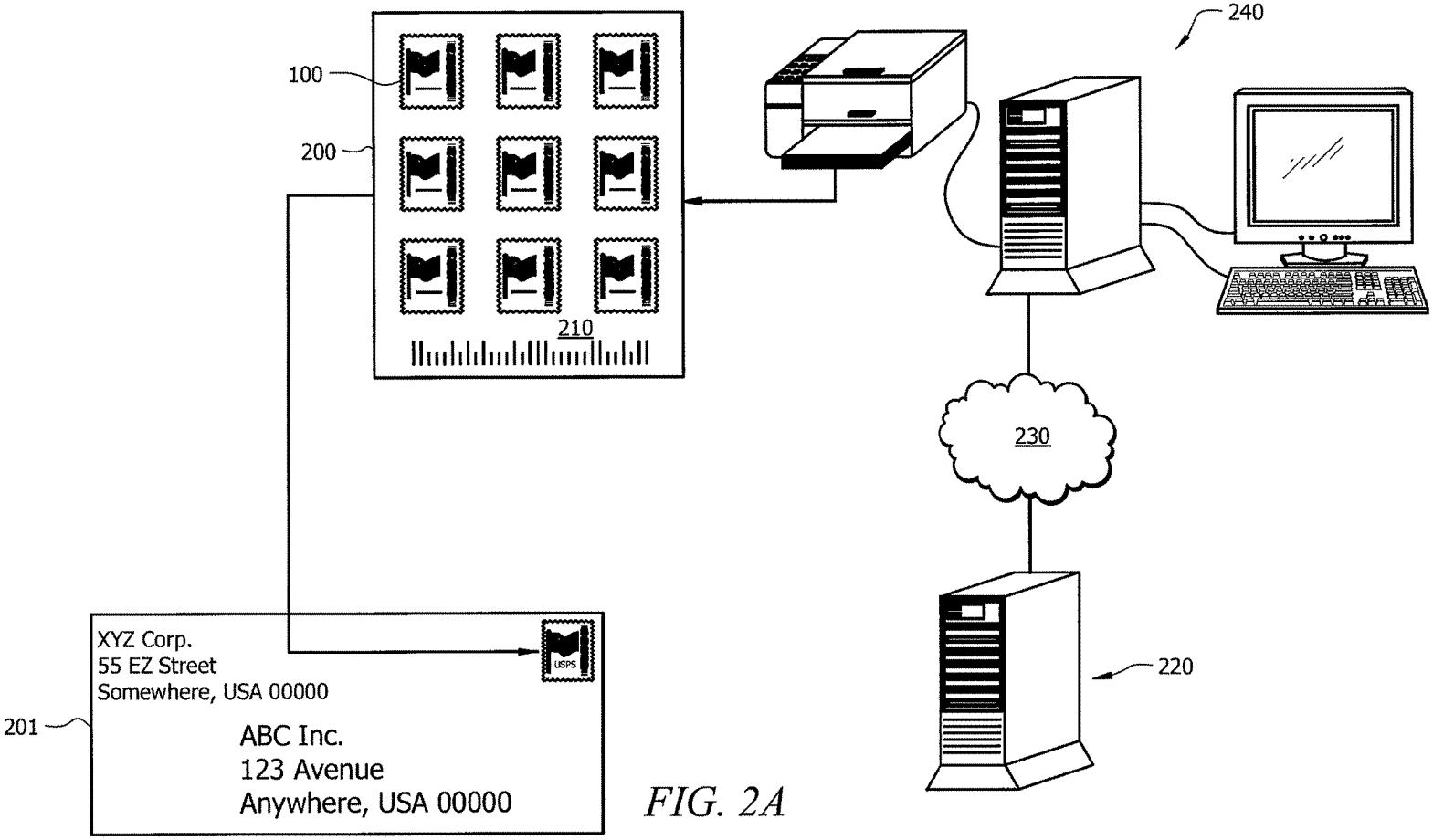
FIG. 2A shows a system for producing secure value bearing indicia using clear media according to embodiments of the invention.
Figure 2B:
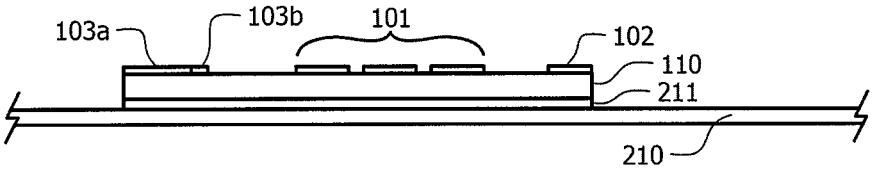
FIG. 2B shows an elevation view of a secure value bearing indicia disposed upon the sheet produced by the system of FIG. 2A according to embodiments of the invention.
Figure 2C:
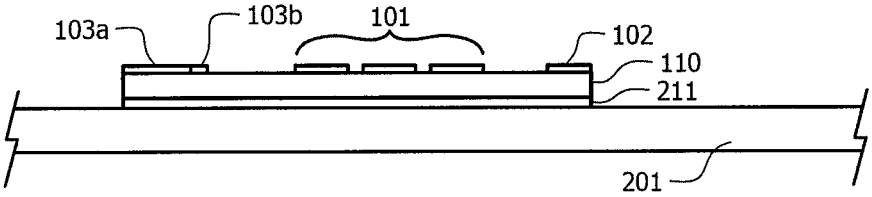
FIG. 2C shows an elevation view of a secure value bearing indicia disposed upon the postal item of FIG. 2A according to embodiments of the invention.

Clear fungible postage indicium 100 may be created by a user for later use in posting postal items as needed. For example, a user may utilize computer system 240 shown in FIG. 2A to create clear fungible postage indicium 100 as one of a plurality of clear fungible postage indicia. Specifically, clear fungible postage indicium 100 may be printed upon sheet 200 along with other clear fungible postage indicia for use at any time and with any postal item by the user. As needed, one or more clear fungible postage indicia may be removed from sheet 200 and applied to a postal item, such as postal item 201, for posting. The clear fungible postage indicia may be adhered to a carrier (shown as carrier 210) of sheet 200 using a pressure sensitive adhesive (e.g., a clear permanent acrylic dispersion adhesive such as RP37 available from UPM Raflatac, Inc.) which allows the clear fungible postage indicia to be removed from the carrier and adhered to a face of a host object, such as postal item 201. For example, carrier 210 may be provided with a coating which reduces the adhesive bond allowing clear fungible postage indicium 100 to be removed relatively easily from the carrier, while postal item 201 has no such coating thereby resulting in a relatively strong adhesive bond between clear fungible postage indicium 100 and postal item 201. FIG. 2B shows an elevation view of a clear fungible postage indicium as disposed upon carrier 210 according to embodiments, wherein adhesive 211 present upon a back surface of the clear medium holds the clear fungible postage indicium to carrier 210 for handling (e.g., printing, storing, etc.) prior to removal and application upon a host object (e.g., postal item 201). FIG. 2C shows an elevation view of the clear fungible postage indicium of FIG. 2B as placed upon postal item 201, wherein adhesive 211 present upon the back surface holds the clear fungible postage indicium to postal item 201.

System 240 used to generate clear fungible postage indicium herein may comprise a processor (e.g., a processor from the CORE processor family available from Intel Corporation), memory (e.g., random access memory (RAM), read only memory (ROM), disk memory, optical memory, flash memory, and/or the like), and suitable input and output functionality (e.g., display, keyboard, digital pointer, printer, microphone, speaker, scanner, touch screen, biometric sensor, and/or the like) operable under control of an instruction set (e.g., operating system, application program, applet, etc.) providing for the generation of clear fungible postage indicia herein. System 240 may communicate with server system 220, such as via network 230 (e.g., a local area network (LAN), a wide area network (WAN), the Internet, the public switched telephone network (PSTN), a wireless network, and/or the like), for obtaining postage value to be included in the value bearing indicia, to generate the value bearing indicia, etc. Additional detail with respect to the generation of fungible postage indicia is shown in U.S. Pat. No. 6,939,062 entitled "System and Layout for Proper Printing of NETSTAMPS and Other Labels" and U.S. Pat. No. 7,083,345 entitled "Roll Label Layout and System for Proper Printing of NETSTAMPS," previously incorporated by reference.

Sheet 200 of the illustrated embodiment comprises carrier 210 upon which a plurality of transfer areas are provided for separation and use as value bearing indicia. For example, a plurality of postage stamp sized transfer areas made from a plastic medium (e.g., polyethylene, polypropylene, polystyrene, vinyl, polyester, etc.) giving a desired level of transparency/translucency may be provided upon carrier 210 for printing upon by a printer (e.g., laser printer, inkjet printer, thermal transfer printer, dot matrix printer, etc.) of system 240 for providing clear fungible postage indicia herein. Sheet 200 and/or the transfer sections thereon may be preprinted or otherwise pre-provided with one or more portions of a completed clear fungible postage indicia according to embodiments of the invention. For example, transfer sections of sheet 200 may be pre-provided with all or a portion of human readable information 101, medium code 104 and/or aesthetics 105. Printing of the remaining portions of the clear fungible postage indicia may be provided by a printer of system 240, perhaps in cooperation with or under control of server 220, to complete the clear fungible postage indicia.

It should be appreciated that although a sheet having a plurality of transfer sections for creating clear fungible postage indicia is shown, embodiments are not limited to the use of sheets or even configurations in which a plurality of clear fungible postage indicia are created at any particular time. For example, embodiments of the invention may utilize a carrier in the form of a roll, such as may be utilized in a label printer or other continuous web printer.

Clear media utilized in clear fungible postage indicia of embodiments of the invention may present a relatively resilient membrane which is resistant to tearing, delaminating, and other destructive forces. Accordingly, the use of clear media for fungible postage indicia presents an increased risk that the clear fungible postage indicia may be reused if not otherwise adapted to discourage such reuse. Clear fungible postage indicia of embodiments of the present invention are adapted to include one or more security features to prevent or otherwise discourage reuse and/or copying of such fungible postage indicia borne on clear media.

Figure 3A:
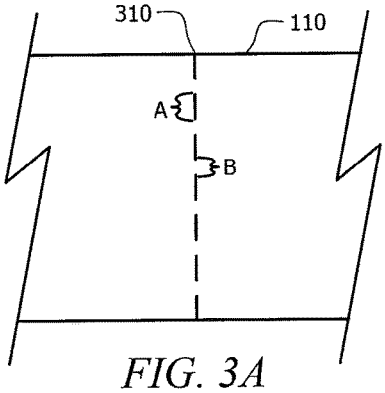
FIGS. 3A and 3B show controlled cuts in clear media according to an embodiment of the invention.
Figure 4A:
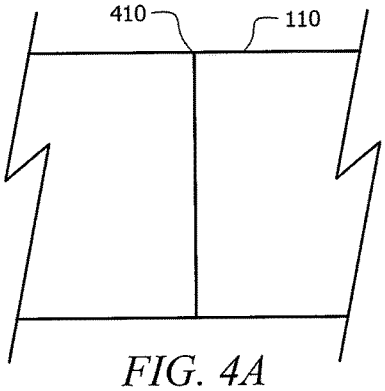
FIGS. 4A and 4B show controlled cuts in clear media according to another embodiment of the invention.

Embodiments of the invention provide clear fungible postage indicia having one or more controlled cut in the surface of the clear media to facilitate the destruction of the clear fungible postage indicia when removal is attempted after affixing to a host object. Controlled cuts utilized according to embodiments of the invention may comprise perforation lines, score lines, or combinations thereof. For example, perforation line 310 shown in FIGS. 3A (plan view) and 3B (elevation view) as comprising a plurality of discrete cuts fully penetrating clear medium 110 (e.g., penetrating clear medium 110 to carrier 210) interleaved with a plurality uncut portions of clear medium 110, may be utilized as a controlled cut for facilitating destruction of clear fungible postage indicia according to embodiments of the invention. Additionally or alternatively, score line 410 shown in FIGS. 4A (plan view) and 4B (elevation view) as comprising a cut line partially penetrating clear medium 110 (e.g., not penetrating clear medium 110 to carrier 210) leaving some portion of clear medium 110 uncut, may be utilized as a controlled cut facilitating destruction of clear fungible postage indicia according to embodiments of the invention.

Controlled cut configurations of embodiments of the invention present sufficient structural integrity for printing of the clear fungible postage indicia (e.g., passing through a printer of computer system 240) and their initial application to a host object (e.g., removal from carrier 210 and application upon postal item 201) while introducing areas of diminished structural integrity adapted to facilitate destruction or otherwise disabling the clear fungible postage indicia when removal from a host object (e.g., subsequent removal from postal item 201 after application thereto, perhaps after a period of time sufficient for an adhesive of the indicium to set) is attempted. Embodiments of the invention adapt attributes of the controlled cuts for characteristics of the clear fungible postage indicia, such as characteristics of the clear media (e.g., the tearing strength, the shear strength, the resilience, the dimensional stability, etc.), characteristics of the adhesive (e.g., the strength, the areas of application, the resilience, etc.), and/or the printing (e.g., the areas of printing, the types of ink used, the type of printing technique used, etc.).

Figure 3B:
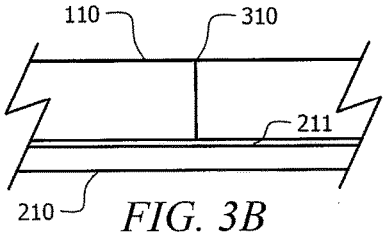
Figure 4B:
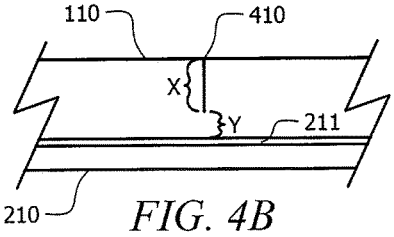

It should be appreciated that an adhesive, such as adhesive 211 shown in FIGS. 3B and 4B, may be present between clear medium 110 and carrier 210. For example, a thin film of adhesive, whether in a solid sheet, in a particular pattern, and/or having various adaptations as desired for providing operation herein, may be present upon a back face of clear medium 110. Such an adhesive layer may or may not be penetrated by controlled cuts of embodiments herein, depending upon the particular structural and security characteristics sought. The adhesive may hold clear medium 110 on carrier 210 for generation (e.g., printing) of clear fungible postage indicium 100 and subsequent handling by a user, while allowing separation of carrier 210 from clear medium 110 without appreciable damage thereto for application of clear fungible postage indicium 100 to a host object, such as postal item 201. The adhesive may thereafter fasten clear fungible postage indicium 100 to a host object, such as postal item 201, sufficiently to deter removal and reuse of the indicium using security attributes of embodiments of the invention. For example, the adhesive may be a clear pressure sensitive adhesive, such as the RP37 clear permanent acrylic dispersion adhesive available from UPM Raflatac, Inc., which sufficiently sets within 24 hours of application to an intended host surface to discourage removal and reuse of the indicium.

The ratio of the perforations (i.e., the ratio of perforation cut length (A in FIG. 3A) to remaining web length (B in FIG. 3A)) is adapted according to embodiments of the invention for the attributes of the clear medium and/or adhesive used in order to provide suitable security. For example, where the clear medium comprises a thin polyester film, which provides a relatively resilient membrane having good dimensional stability, a perforation ratio of less than 1 (i.e., $B/A<1$, or less than 50% media remains in the perforation line, and thus more than 50% of the media is cut through) may be used to facilitate destruction of clear fungible postage indicia when removed from a host object. The perforation ratio where the clear medium is more resistant to tearing, however, may be lower (i.e., $B/A<0.25$, or less than 20% media remains in the perforation line, and thus more than 80% of the media is cut through) to provide sufficient structural integrity for printing of the indicia and/or their initial application to a host object.

The depth of score lines (i.e., the ratio of the depth of a scoring cut (X in FIG. 4B) to depth of web remaining uncut (Y in FIG. 4B)) is adapted according to embodiments of the invention for the attributes of the clear medium and/or adhesive used in order to provide suitable security. For example, where the clear medium comprises a thin polyester film, which provides a relatively resilient membrane having good dimensional stability, a score depth of more than 50% (i.e., $X/Y>1$, or less than 50% media remains uncut in the score line, and thus more than 50% of the media is cut through) may be used to facilitate destruction of clear fungible postage indicia when removed from a host object. The score depth where the clear medium is more resistant to tearing, however, may be more than 66% (i.e., X/Y>2, or less than 33% media remains in the score line, and thus more than 66% of the media is cut through) to provide sufficient structural integrity for printing of the indicia and/or their initial application to a host object.

It should be appreciated that embodiments of the invention may utilize controlled cuts implementing a combination of the aforementioned perforation lines and score lines. For example, an embodiment of the invention may utilize one or more perforation line with respect to one area of a clear fungible postage indicium and one or more score line with respect to another area of the clear fungible postage indicium. Moreover, the scoring technique may be utilized with respect to a perforation line, whereby in addition to a perforation ratio a score depth less than the full depth of the clear media is implemented (e.g., the perforation cuts shown in FIG. 3A are scored as shown in FIG. 4B). Such a hybrid scored perforation line configuration may be useful with respect to relatively fragile clear media to provide sufficient structural integrity for printing of the indicia and/or their initial application to a host object, for example.

Attributes of the controlled cuts adapted for characteristics of the clear fungible postage indicia may comprise features in addition to or in the alternative to the aforementioned perforation ratio and score depth. For example, patterns in which controlled cuts are provided in the clear media are preferably adapted to facilitate desired destruction of the clear fungible postage indicia.

Controlled cuts utilized according to embodiments of the invention may be disposed at particular locations and/or oriented on a clear fungible postage indicium to encourage or ensure destruction of the indicium if removal from a host object (e.g., postal item 201) is attempted. For example, a person attempting to remove an indicium from a host object tends to attempt to initially separate the indicium from the host object at the corners of the indicium medium. Thus, controlled cuts of embodiments of the invention may be disposed at or near the corners or other expected site of initial separation to cause separation of portions of the indicium medium as the person attempts to separate the indicium from the host object. Additionally, a person attempting to remove an indicium from a host object tends to peel the indicium from the host object after separating a small portion from the host object. Thus, controlled cuts of embodiments of the invention may be oriented with regard to one or more expected directions of peeling the indicium medium to cause separation of portions of the indicium medium as the person attempts to separate the indicium from the host object.

Controlled cuts of embodiments of the invention not only provide for separation of portions of the medium for destruction of the indicium, but may additionally result in physical deformation, distortion, etc. (collectively, alteration) of the medium. For example, the portions of perforation line 310 remaining uncut may be adapted (e.g., sized and/or shaped) to provide sufficient structural integrity to cause stretching or other alteration of the medium as the portions of the medium are separated when an attempt to separate the indicium from the host object is made. Such alteration of the medium renders the separated portions of the clear fungible postage indicium more difficult, if not impossible, to subsequently piece together without readily apparent signs of tampering (e.g., stretched portions of the torn perforation line prevent the separated pieces from abutting one another to appear unified as before separation of the indicium from the host object.

The portions of the indicium medium separated by controlled cuts of embodiments herein may be selected to further facilitate rendering the indicium unusable, to avoid interference with particular portions of the indicium, to facilitate printing of various indicia information, etc. Accordingly, various controlled cut patterns may be utilized according to embodiments of the invention.

Figure 5:
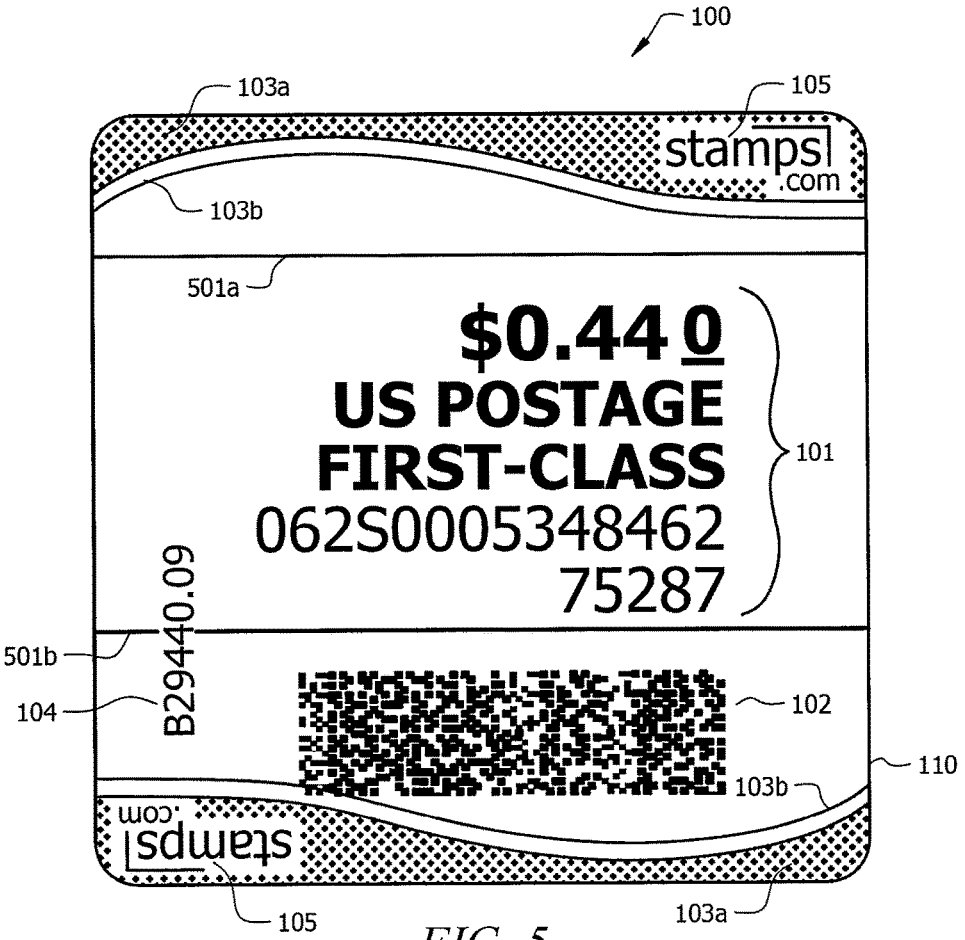
FIGS. 5-9 show controlled cut patterns in secure value bearing indicia using clear media according to embodiments of the invention.

Directing attention to FIG. 5, a controlled cut pattern which results in separation of particular portions of the clear fungible postage indicia is shown. Specifically, controlled cuts 501*a* and 501*b*, which may comprise perforation lines, score lines, etc., are disposed to facilitate separation of human readable indicia information 101, machine readable indicia information 102, and markers 103*a* and 103*b*. Such a pattern of controlled cuts results in portions of the clear fungible postage indicia which are often critical to successful processing and/or validation being separated from one another when removed from a host object (e.g., postal item 201), thus likely resulting in the clear fungible postage indicia being prevented from successful reuse. Moreover, the controlled cuts of the embodiment of FIG. 5 are disposed to avoid interfering with the printing of information, such as the contents of human readable indicia information 101, machine readable indicia information 102, and markers 103*a* and 103*b*, such as by a printer of computer system 240 and/or of a supplier of sheet 200.

Figure 6:
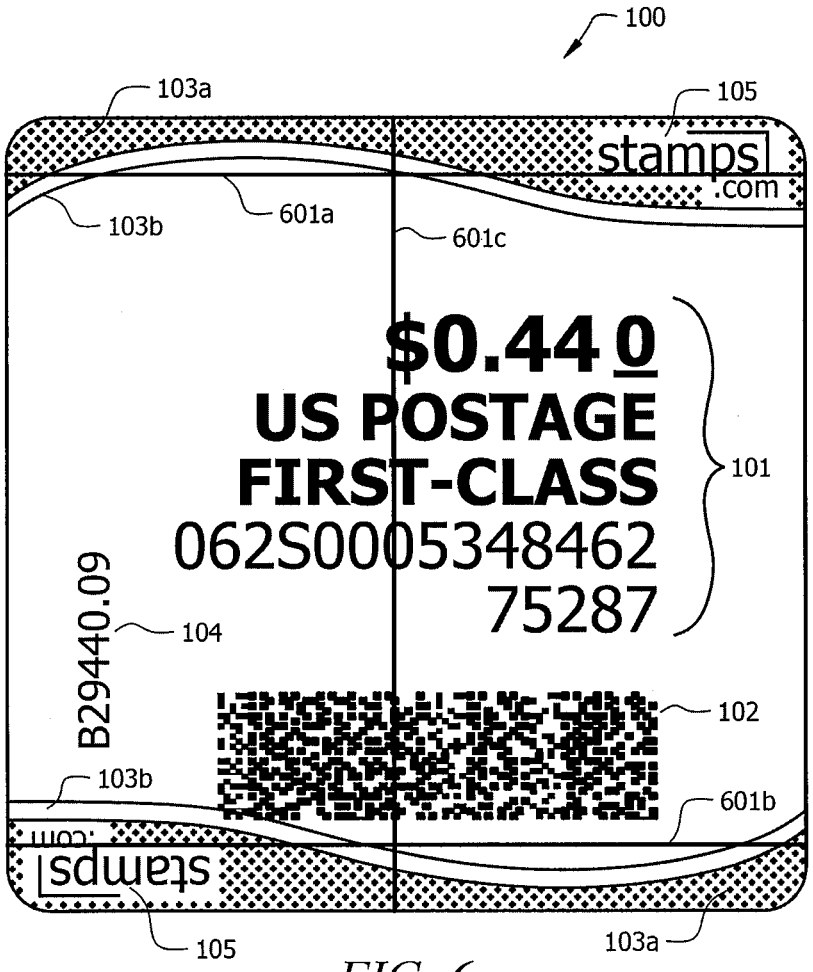

Additionally or alternatively, a controlled cut pattern or patterns may be utilized which result in the breaking up of particular portions of the clear fungible postage indicia (e.g., breaking any of a human readable portion, a machine readable portion, and/or an marker portion into smaller pieces). Directing attention to FIG. 6, a controlled cut pattern which results not only in separation of portions of the clear fungible postage indicia, but also in breaking up of particular portions of the clear fungible postage indicia, is shown. Specifically, controlled cuts 601*a*, 601*b*, and 601*c*, which may comprise perforation lines, score lines, etc., are shown in the embodiment of FIG. 6. Controlled cut 601*a* is disposed to facilitate separation of markers 103*a* and 103*b*, controlled cut 601*b* is disposed to facilitate breaking up of machine readable indicia information 102 ad separation of markers 103*a* and 103*b*, and controlled cut 601*c* is disposed to facilitate breaking up of human readable indicia information 101, machine readable indicia information 102, and markers 103*a* and 103*b*. Such a pattern of controlled cuts results in portions of the clear fungible postage indicia which are often critical to successful processing and/or validation being broken up when removed from a host object (e.g., postal item 201), thus likely resulting in the clear fungible postage indicia being prevented from successful reuse.

It should be appreciated that disposing controlled cuts through various information printed upon the indicium medium may result in some impact upon the quality of the printed information. For example, surface perturbations associated with the controlled cuts may result in small spaces where ink or other printing material is missing from the printed rendition of the information. Such impacts upon the quality of the printed information are expected to generally be acceptable for processing and validation of the clear fungible postage indicia. For example, machine readable indicia information 102 is likely to be the most susceptible to problems resulting from reduced printing quality. However, machine readable coding techniques, such as those of the PDF417, DATAMATRIX, MAXICODE, and other two-dimensional bar codes, provide error correction able to accommodate relatively poor print quality and other sources of damage to the barcode. Nevertheless, it may be desirable to provide a controlled cut pattern which does not pass through selected information printed upon the indicium.

Figure 7:
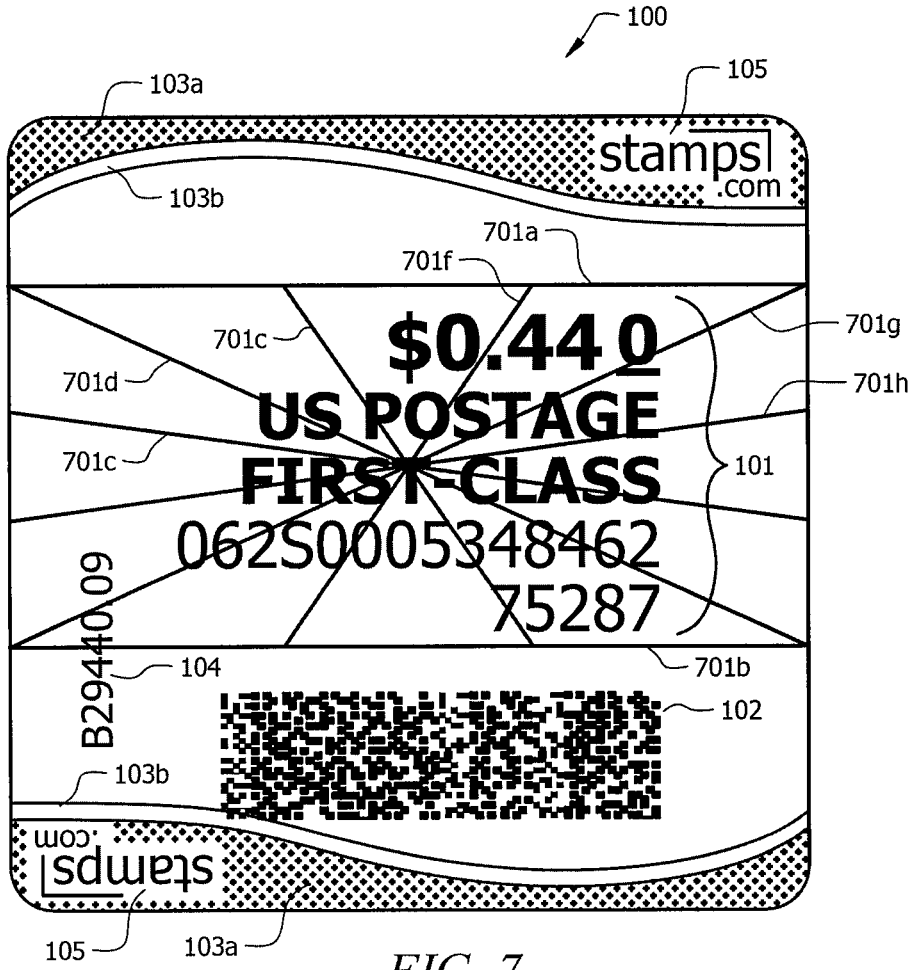

Directing attention to FIG. 7, an embodiment wherein a pattern of controlled cuts is used which provides for breaking up of some portions of the clear fungible postage indicia and separation, without breaking up, of other portions of the clear fungible postage indicia. Controlled cuts 701*a* through 701*h*, which may comprise perforation lines, score lines, etc., are shown in the embodiment of FIG. 7. Controlled cuts 701*a* and 701*b* are disposed to facilitate separation of human readable indicia information 101, machine readable indicia information 102, and markers 103*a* and 103*b*. Additionally, controlled cuts 701*c* through 701*h* are disposed to facilitate breaking up of human readable indicia information 101. As can be appreciated from the embodiment illustrated in FIG. 7, controlled cut patterns may avoid controlled cuts in certain areas, such as a machine readable portion to avoid interfering with the functionality of that portion of the clear fungible postage indicia, while providing controlled cuts within other areas, such as the human readable portion to facilitate breaking up of that portion of the clear fungible postage indicia.

Figure 8:
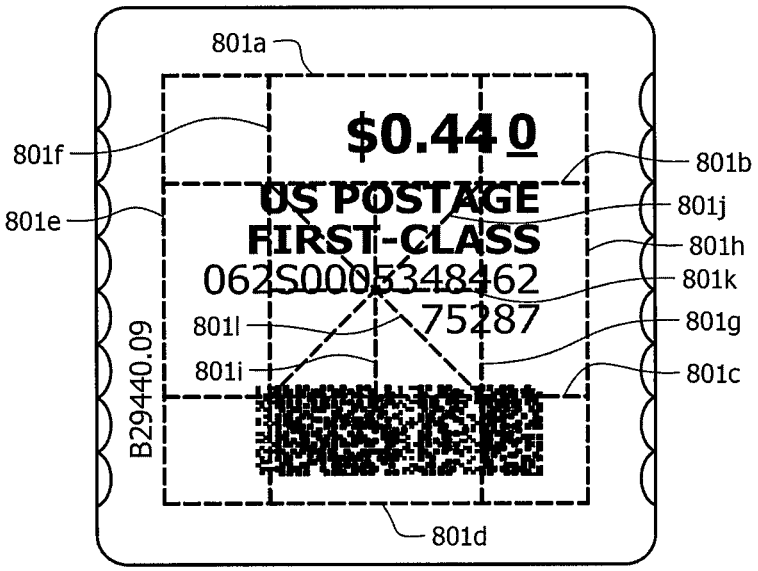

FIG. 8 shows an embodiment wherein a pattern of controlled cuts, shown as perforation cut lines 801*a*-8011, are provided to facilitate destruction and/or separation of various portions of the clear fungible postage indicium. For example, perforation cut lines 801*a*, 801*b*, 801*e*, and 801*f* facilitate separation of a particular portion of human readable indicia information 101 while perforation cut lines 801*b*, 801*c*, 801*f*, 801*g*, and 801*i*-8011 facilitate breaking up of another portion of human readable indicia information 101. Perforation cut lines 801*c*, 801*d*, 801*e*, 801*f*, and 801*g* of the illustrated embodiment facilitate breaking up of machine readable indicia information 102.

Figure 9:
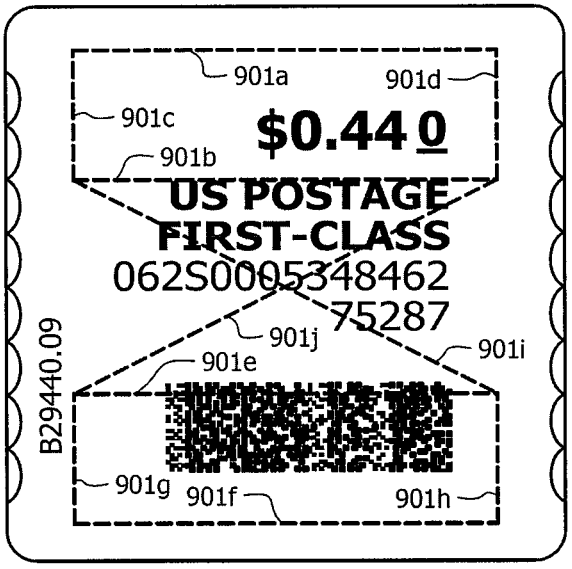

FIG. 9 shows another embodiment wherein a pattern of controlled cuts, shown as perforation cut lines 901*a*-901*j*, are provided to facilitate destruction and/or separation of various portions of the clear fungible postage indicium. In the embodiment of FIG. 9, perforation lines 901-901*d* facilitate separation of a particular portion of human readable indicia information 101 while perforation cut lines 901*b*, 901*e*, 901*i*, and 901*j* facilitate breaking up of another portion of human readable indicia information 101. Perforation cut lines 901*e*-901*h* facilitate breaking up and separation of machine readable indicia information 102.

It should be appreciated that the embodiments of FIGS. 8 and 9 illustrate the use of perforation cut line configurations of embodiments of the invention. In order to facilitate destruction of the various portions of the clear medium, the intersections of the perforation cut lines shown in the illustrated embodiments include joined perforations. That is, perforations of the different intersecting perforation cut lines are made to join to thereby provide a weakened intersection for facilitating separation and destruction of the various portions of the clear medium. Alternative embodiments of the invention may not use joined perforations at some or all such perforation line intersections, such as at particular locations susceptible to premature destruction of the clear medium (e.g., a location prone to substantial bending during removal from a carrier for placement upon a host object). Such embodiments may utilize a configuration wherein, although the perforations do not necessarily join at a perforation line intersection, the intersection is sufficiently weakened (e.g., through the use of a higher perforation ratio at the intersection than used at other portions of the perforation cut line) to facilitate destruction of a clear fungible postage indicium upon removal from a postal item. Such weakened perforation cut line intersections may be additionally or alternatively provided using score lines (e.g., the web of remaining clear medium between perforation cuts may itself be scored) according to embodiments.

Although FIGS. 8 and 9 are discussed above with respect to perforation cut lines and the use of weakened perforation cut line intersections to facilitate destruction of a clear fungible postage indicium, score line embodiments of the invention may be similarly adapted. For example, the depth of the score lines may be increased at score line intersections to thereby weaken the intersections.

Clear fungible postage indicia of embodiments may implement techniques in addition to or in the alternative to the foregoing controlled cuts for providing security. For example, embodiments of the invention may utilize a laminated or multi-layer clear medium configuration adapted to facilitate destruction of the clear fungible postage indicia produced therewith. According to embodiments of the invention, multiple layers (e.g., 2 or 3 layers) of very thin clear plastic media may be adhered together to provide a laminated clear medium (e.g., to provide a top layer upon which information of a clear fungible postage indicium is printed and a bottom layer upon which an adhesive is provided to adhere the clear fungible postage indicium to a host object, wherein the top layer and bottom layer are laminated together to provide a multi-layer medium). The adhesive or adhesives used in laminating the layers may be selected to provide sufficient integrity of the laminated clear medium to facilitate handling of clear fungible postage indicia, such as when being printed, removed from a carrier substrate, and placed upon a host object, but which results in delaminating or partial delaminating when an attempt is made to remove the clear fungible postage indicia from the host object. The adhesive or adhesives used in laminating the layers of the laminated clear medium may, for example, provide less adhesive force than that of the adhesive or adhesives used to affix the clear fungible postage indicia upon the host object. It should be appreciated that the foregoing laminated clear medium security techniques may be implemented in combination with the controlled cuts discussed above, such as to provide a clear medium which is highly likely to facilitate the destruction of a clear fungible postage indicium made therewith.

Additionally or alternatively, techniques for providing security implemented according to embodiments of the invention may comprise features other than adaptation of the clear medium itself. For example, embodiments of the invention may utilize adhesive patterning to facilitate destruction or otherwise disabling the clear fungible postage indicia when removal from a host object is attempted. According to an embodiment, adhesive patterning may deposit adhesive in particular areas and leave other areas free of adhesive (e.g., areas near and/or underlying a controlled cut) to work cooperatively with a controlled cut to facilitate separation of portions of the clear medium when the fungible postage indicia is removed from a host object. For example, an adhesive pattern may be applied to the back of the clear medium of clear fungible postage indicium 100 in a pattern corresponding to that of the controlled cuts, leaving areas of no adhesive corresponding to one or more controlled cuts, in order to facilitate separation of the portions of the indicium medium at the controlled cuts.

Figure 10:
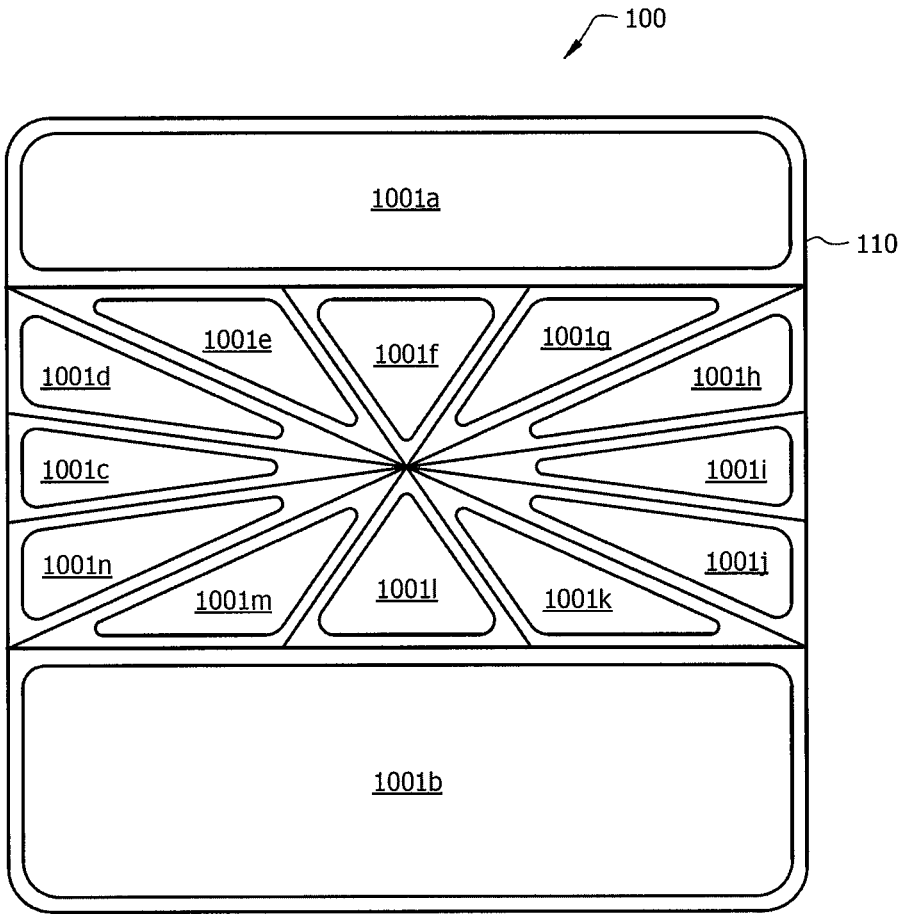
FIG. 10 shows adhesive patterning in secure value bearing indicia using clear media according to embodiments of the invention.

FIG. 10 shows an embodiment of adhesive patterning as comprising adhesive areas 1001*a* through 1001*n* applied to the back of clear medium 110 in correspondence to controlled cuts 701*a* through 701*h* shown in FIG. 7. In the embodiment of FIG. 10, adhesive areas 1001*a* through 1001*n* provide adhesive to the uncut portions of clear medium 110 while leaving areas without adhesive corresponding to controlled cuts 701*a* through 701*h*. Accordingly, the uncut portions of clear fungible postage indicium 100 will be encouraged to remain on a host object while the controlled cuts are free to separate from one another as the indicium is being removed from the host object. Thus, destruction of the clear fungible postage indicia when removal is attempted after affixing to a host object is facilitated through the use of such adhesive patterning.

Embodiments of the invention may additionally or alternatively utilize adhesive adaption in the form of adhesion characteristic variation to facilitate destruction or otherwise disabling the clear fungible postage indicia when removal from a host object is attempted. Such adhesion characteristic variation may comprise the use of adhesives of different adhesion characteristics used at different portions of the clear medium (e.g., exterior edges, portions at or near controlled cuts, beneath particular aspects of the fungible postage indicia, etc.) for facilitating destruction of the clear fungible postage indicia.

Adhesive adaption in the form of visible characteristics may additionally or alternatively be used to provide security with respect to clear fungible postage indicia. According to an embodiment, adhesive adaption in the form of adhesive colorization may be utilized to provide a pattern (e.g., image, logo, text, information, etc.) within the adhesive. For example, medium code 104, aesthetics 105, (FIG. 1) etc. may be provided through use of adhesive colorization to "print" the pattern within the adhesive on the back face of clear medium 110 (e.g., adhesive 211 shown in FIG. 2B). For example, clear medium 110 may have adhesive 211 applied to a back face thereof (e.g., before placing clear medium 110 upon carrier 210) during a manufacturing process. A portion of the adhesive may be colorized to provide a desired pattern (e.g., symbols, characters, graphic image, etc.) and/or a colorized agent or ink may be applied to a portion of the adhesive after its deposit upon the back face of the clear medium to provide a desired pattern. Such an adhesive colorization patterns are preferably visible through clear medium 110 of clear fungible postage indicia 100. Moreover, because the pattern (e.g., the alphanumeric characters of code 104) is provided in the adhesive layer used to attach clear fungible postage indicia 100 to a host object, such as postal item 201, the pattern is highly likely to be visibly altered or damaged if the clear fungible postage indicia is removed from a host object. For example, the pattern of adhesive colorization may be separated from the clear medium, partially separated from the clear medium, smudged or smeared, etc., thereby providing visual evidence of removal or attempted removal of clear fungible postage indicia 100 from a host object.

Adhesive colorization and patterning may be provided in a number of ways according to embodiments of the invention. For example, a desired pattern (medium code 104, aesthetics 105, (FIG. 1) etc.) may be applied (e.g., sprayed, ink jet printed, silk screened, etc.) in ink or other colorizing agent to the back of an adhesive layer already present on a back face of the clear medium. Such an application of colorization to the adhesive may be particularly effective in providing visible separation of the pattern upon the attempted removal of the clear medium from a host object due to its being disposed on the surface interfacing with the host object. Adhesive colorization patterning may additionally or alternatively be applied through patterned application of colorized adhesive (e.g., similar to the techniques used in adhesive patterning resulting in the patterns shown in FIG. 10). For example, colorized adhesive may be "printed" in a desired pattern (medium code 104, aesthetics 105, (FIG. 1) etc.) and clear adhesive "printed" in the remaining areas to fully cover a portion of a back face of the clear medium. Such an application of colorization to the adhesive may be partially removed upon the attempted removal of the clear medium from a host object to thereby provide a visual indication of the attempted removal.

It should be appreciated that one or more of the foregoing security features adapted to provide an indication of removal or attempted removal of a clear fungible postage indicium from a host object may not be the only security features implemented according to embodiments of the invention. Security features, such as the use of special inks, may be utilized to prevent the copying and reproduction of clear fungible postage indicia according to embodiments of the invention. For example, special inks which are invisible under natural light, but which fluoresce under light of a particular wavelength (e.g., ultraviolet light), may be applied to clear medium 110 (e.g., to form all or a part of include human readable information 101, machine readable information 102, markers 103*a* and 103*b*, medium code 104, and/or aesthetics 105) to render reproduction by typical copying techniques ineffective.

The use of special inks which are invisible under natural light (e.g., inks which fluoresce under ultraviolet light) are particularly useful with respect to clear fungible postage indicia of embodiments due to their use not substantially impacting the aesthetics provided by the use of the clear fungible postage indicia. For example, markers 103*a* and/or 103*b* may be comprised entirely of such special inks for use in automated processing of postal items, facing of postal items for processing, postage indicium validation, etc., without significantly impacting or otherwise altering the appearance of clear fungible postage indicia 100.

Special inks which visually appear to have different characteristics (e.g., change color), such as thermo-chromatic inks, may additionally or alternatively be applied to the clear fungible postage indicium medium to render reproduction by typical copying techniques ineffective. For example, aesthetics 105 may be provided to include a portion comprised of such special inks to facilitate validation of clear fungible postage indicia 100 through the use of special inks in an unobjectionable manner. Although such visible inks may not be preferred according some embodiments due to it impact upon the aesthetics provided by the use of the clear fungible postage indicia, there use in a subtle or otherwise aesthetically pleasing way may not be objectionable.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A value bearing indicium comprising:

a first portion of indicia information;

a second portion of indicia information, wherein both of the first and second portions of indicia information are required for a predetermined pecuniary value to be considered valid, and wherein the predetermined pecuniary value is borne by the value bearing indicium; and a clear medium bearing the first and second portions of indicia information, wherein the clear medium includes one or more controlled cuts disposed therein and adapted to render the predetermined pecuniary value invalid if removed from a host object by separation of areas of the clear medium bearing the one or more of the first and second portions of indicia information, the one or more controlled cuts defining a first separation section associated with the first portion of the indicia information and a second separation section associated with the second portion of the indicia information and being adapted to cause separation of at least a portion of the first and second portions of indicia information if removed from the host object, the one or more controlled cuts further defining a breakup section associated with a third portion of indicia information and being adapted to cause breaking up of at least a portion of the third portion of indicia information if removed from the host object.

2. The value bearing indicium of claim 1, wherein the one or more controlled cuts comprises at least one perforation cut line, wherein the perforation cut line comprises a plurality of cuts penetrating the clear medium.

3. The value bearing indicium of claim 2, wherein a perforation ratio of the perforation cut line cuts is between 1 and 0.25.

4. The value bearing indicium of claim 1, wherein the one or more controlled cuts comprises at least one score line, wherein the score line comprises a cut partially penetrating the clear medium.

5. The value bearing indicium of claim 4, wherein a score depth ratio of the one or more controlled cuts is between 1 and 2.

6. The value bearing indicium of claim 1, wherein the one or more controlled cuts are adapted to facilitate handling of the value bearing indicium prior to its application upon the host object and to facilitate destruction of the value bearing indicium when an attempt to remove the value bearing indicium is made after its application upon the host object.

7. The value bearing indicium of claim 6, wherein the adaptation of the one or more controlled cuts comprises leaving a predetermined amount of clear medium remaining at the one or more controlled cuts to facilitate the handling and destruction.

8. The value bearing indicium of claim 6, wherein the adaptation of the one or more controlled cuts comprises disposing a plurality of controlled cuts of the one or more controlled cuts in a pattern adapted to facilitate destruction of the value bearing indicium when an attempt to remove the value bearing indicium from the host object is made from one or more expected points of attack.

9. The value bearing indicium of claim 1, wherein the one or more controlled cuts comprise a plurality of cuts disposed in a predetermined pattern to avoid causing interference with processing of the first and second portions of indicia information and to facilitate destruction of the value bearing indicium when an attempt to remove the value bearing indicium is made after its application upon the host object.

10. The value bearing indicium of claim 1, wherein the one or more controlled cuts comprises a first controlled cut disposed between a first area of the clear medium bearing the first portion of indicia information and a second area of the clear medium bearing the second portion of indicia information, and wherein the first controlled cut is adapted to cause separation of the first and second areas if the value bearing indicium is removed from the host object.

11. The value bearing indicium of claim 1, wherein the clear medium comprises a transparent, adhesive backed film.

12. The value bearing indicium of claim 1, wherein the clear medium comprises a translucent, adhesive backed film.

13. The value bearing indicium of claim 1, wherein the clear medium comprises a plurality of laminated films.

14. The value bearing indicium of claim 1, wherein the first portion of indicia information, the second portion of indicia information, and the third portion of indicia information are each selected from the group consisting of human readable indicia information, machine readable indicia information, and a marker used in processing the value bearing indicium, wherein at least one of the first portion, the second portion, and the third portion is a marker used in processing the value bearing indicium.

15. The value bearing indicium of claim 1, wherein the first portion of indicia information, the second portion of indicia information, and the third portion of indicia information are each a different one of human readable indicia information, machine readable indicia information, and a marker used in processing the value bearing indicium.

16. The value bearing indicium of claim 1, wherein the third portion of indicia information is provided as a colorized portion of an adhesive backing of the clear medium.

17. The value bearing indicium of claim 1, wherein the value bearing indicium comprises a clear fungible postage indicium providing the predetermined pecuniary value as postage value, and wherein the host object comprises a postal item.

18. A clear medium adapted for use in a value bearing indicium, the clear medium comprising:

a clear adhesive backed film; and one or more controlled cuts disposed therein and adapted to render a predetermined pecuniary value being borne by the value bearing indicium invalid if removed from a host object by separation of areas of the clear medium bearing one or more portions of indicia information, the one or more controlled cuts defining a first separation section associated with a first portion of the indicia information and a second separation section associated with a second portion of the indicia information and being adapted to cause separation of at least a portion of the first and second portions of indicia information if removed from the host object, the one or more controlled cuts further defining a breakup section associated with a third portion of indicia information and being adapted to cause breaking up of at least a portion of the third portion of indicia information if removed from the host object.

19. The clear medium of claim 18, wherein the one or more controlled cuts comprises at least one perforation cut line, wherein the perforation cut line comprises a plurality of cuts penetrating the clear medium.

20. The clear medium of claim 19, wherein a perforation ratio of the perforation cut line cuts is between 1 and 0.25.

21. The clear medium of claim 18, wherein the one or more controlled cuts comprises at least one score line, wherein the score line comprises a cut partially penetrating the clear medium.

22. The clear medium of claim 21, wherein a score depth ratio of the one or more controlled cuts is between 1 and 2.

23. The clear medium of claim 18, wherein the one or more controlled cuts are adapted to facilitate handling of a value bearing indicium produced using the clear medium prior to application of the value bearing indicium upon the host object and to facilitate destruction of the value bearing indicium when an attempt to remove the value bearing indicium is made after its application upon the host object.

24. The clear medium of claim 23, wherein the adaptation of the one or more controlled cuts comprises leaving a predetermined amount of clear medium remaining at the one or more controlled cuts to facilitate the handling and destruction.

25. The clear medium of claim 23, wherein the adaptation of the one or more controlled cuts comprises disposing a plurality of controlled cuts of the one or more controlled cuts in a pattern adapted to facilitate destruction of the value bearing indicium when an attempt to remove the value bearing indicium from the host object is made from one or more expected points of attack.

26. The clear medium of claim 18, wherein the one or more controlled cuts comprise a plurality of cuts disposed in a predetermined pattern to avoid causing interference with a predetermined portion of information forming part of the value bearing indicium and to facilitate destruction of the value bearing indicium when an attempt to remove the value bearing indicium is made after its application upon the host object.

27. The clear medium of claim 18, wherein the one or more controlled cuts comprises a first controlled cut disposed between a first area of the clear medium for bearing a first portion of indicia information and a second area of the clear medium for bearing a second portion of indicia information, and wherein the first controlled cut is adapted to cause separation of the first and second areas if the value bearing indicium is removed from the host object.

28. The clear medium of claim 18, wherein the clear medium comprises a transparent plastic film.

29. The clear medium of claim 18, wherein the clear medium comprises a translucent plastic film.

30. The clear medium of claim 18, wherein a predetermined pattern is provided as a colorized portion of adhesive in the adhesive backing of the clear medium.

31. The clear medium of claim 30, wherein the predetermined pattern comprises an aesthetic design.

32. The clear medium of claim 30, wherein the predetermined pattern comprises a sequence of characters.

33. The clear medium of claim 18, wherein the value bearing indicium comprises a clear fungible postage indicium providing the predetermined pecuniary value as postage value, and wherein the host object comprises a postal item.

34. The clear medium of claim 18, wherein the clear medium is borne on a carrier substrate with a plurality of like clear media.

35. The clear medium of claim 34, wherein the carrier substrate comprises a sheet sized and shaped to bear rows and columns of clear media of the plurality of clear media.

36. The clear medium of claim 34, wherein the carrier substrate comprises a roll sized and shaped to bear at least one series of clear media of the plurality of clear media.

37. A method comprising:

providing a clear medium sized and shaped for use as a value bearing indicium wherein the value borne by the value bearing indicium is a predetermined pecuniary value; and making one or more controlled cuts into the clear medium, the one or more controlled cuts being configured to adapt the clear medium for facilitating destruction of the value bearing indicium and for rendering the predetermined pecuniary value invalid if removed from a host object while facilitating handling of the clear medium prior to affixing to the host object, the one or more controlled cuts defining a first separation section associated with a first portion of indicia information and a second separation section associated with a second portion of indicia information and being adapted to cause separation of at least a portion of the first and second portions of indicia information if removed from the host object, the one or more controlled cuts further defining a breakup section associated with a third portion of indicia information and being adapted to cause breaking up of at least a portion of the third portion of indicia information if removed from the host object.

38. The method of claim 37, wherein the clear medium comprises an adhesive backed film.

39. The method of claim 37, wherein making the one or more controlled cuts comprises:

making at least one perforation cut line in the clear medium, wherein the perforation cut line comprises a plurality of cuts penetrating the clear medium.

40. The method of claim 39, wherein a perforation ratio of the perforation cut line cuts is between 1 and 0.25.

41. The method of claim 37, wherein making the one or more controlled cuts comprises:

making at least one score line in the clear medium, wherein the score line comprises a cut partially penetrating the clear medium.

42. The method of claim 41, wherein a score depth ratio of the one or more controlled cuts is between 1 and 2.

43. The method of claim 37, wherein making the one or more controlled cuts comprises:

leaving a predetermined amount of clear medium remaining at the one or more controlled cuts to facilitate the handling and destruction.

44. The method of claim 37, wherein making the one or more controlled cuts comprises:

disposing a plurality of controlled cuts of the one or more controlled cuts in a pattern adapted to facilitate destruction of the value bearing indicium when an attempt is made to remove the value bearing indicium from the host object from one or more expected points of attack.

45. The method of claim 37, wherein making the one or more controlled cuts comprises:

disposing a plurality of cuts in a predetermined pattern to avoid causing interference with a predetermined portion of information forming part of the value bearing indicium and to facilitate destruction of the value bearing indicium when an attempt is made to remove the value bearing indicium after its application upon the host object.

46. The method of claim 37, wherein making the one or more controlled cuts comprises:

making a first controlled cut between a first area of the clear medium for bearing a first portion of indicia information and a second area of the clear medium for bearing a second portion of indicia information, wherein the first controlled cut is adapted to cause separation of the first and second areas if the value bearing indicium is removed from the host object.

47. The method of claim 37, further comprising:

applying a predetermined pattern as a colorized portion of adhesive in an adhesive backing of the clear medium.

48. A value bearing indicium comprising:

a first portion of indicia information;

a second portion of indicia information;

a third portion of indicia information, wherein the first, second, and third portions of indicia information are required for a predetermined pecuniary value to be considered valid, and wherein the predetermined pecuniary value is borne by the value bearing indicium; and a clear medium bearing the first, second, and third portions of indicia information, wherein the clear medium includes one or more controlled cuts disposed therein including one or more controlled cuts defining a first area encompassing at least a portion of the first portion of indicia information, one or more controlled cuts defining a second area encompassing at least a portion of the second portion of indicia information, and one or more controlled cuts defining a third area dividing at least a portion of the third portion of indicia information, the one or more controlled cuts being adapted to render the predetermined pecuniary value invalid if removed from a host object by separation of the first and second areas of the clear medium bearing the first and second portions of indicia information and by breaking up the third area of the clear medium bearing the third portion of indicia information.

* * * * *